US007331647B2

(12) United States Patent
Nakanishi et al.

(10) Patent No.: US 7,331,647 B2
(45) Date of Patent: Feb. 19, 2008

(54) IMAGE RECORDING APPARATUS AND IMAGE RECORDING METHOD FOR THE IMAGE RECORDING APPARATUS IMAGE

(75) Inventors: Masahiro Nakanishi, Ome (JP); Kenichi Okawa, Hachioji (JP)

(73) Assignee: Olympus Corporation, Tokyo (JP)

( * ) Notice: Subject to any disclaimer, the term of this patent is extended or adjusted under 35 U.S.C. 154(b) by 299 days.

(21) Appl. No.: 11/240,310

(22) Filed: Sep. 30, 2005

(65) Prior Publication Data

US 2006/0072138 A1 Apr. 6, 2006

(30) Foreign Application Priority Data

Oct. 4, 2004 (JP) ..... 2004-291688

(51) Int. Cl.
*B41J 29/38* (2006.01)

(52) U.S. Cl. ..... 347/16; 347/19; 347/104; 399/364; 355/24

(58) Field of Classification Search ..... 347/16, 347/19, 104; 355/24; 399/364
See application file for complete search history.

(56) References Cited

U.S. PATENT DOCUMENTS 4,935,786 A * 6/1990 Veeder ..... 399/401
2006/0125901 A1* 6/2006 Verhoest et al. ..... 347/104

FOREIGN PATENT DOCUMENTS

| | | | | |
|---|---|---|---|---|
| JP | 04-271368 | A | | 9/1992 |
| JP | 04271368 | A | * | 9/1992 |
| JP | 04-279373 | A | | 10/1992 |
| JP | 3068595 | B2 | | 5/2000 |
| JP | 3084763 | B2 | | 7/2000 |
| JP | 3178851 | B2 | | 4/2001 |

* cited by examiner

*Primary Examiner*—Justin Seo
(74) *Attorney, Agent, or Firm*—Frishauf, Holtz, Goodman & Chick, P.C.

(57) ABSTRACT

An apparatus and method for printing images on both sides of a recording medium. The timing of starting conveying the next recording medium is determined from a schedule that satisfies three conditions. The first condition a leading end of the next medium reaches a housing section, while maintaining a page gap, when the medium passes completely through the housing section. The second condition both media are not at a recording-medium supply position and the leading end of the next medium reaches the supply position, while maintaining a page gap, when the medium passes completely through the supply position. The third condition when the medium is turned upside down, both media are not at a reversing path section, and the leading end of the next medium reaches the reversing path section, while maintaining a page gap, when the medium passes completely through the reversing path section.

7 Claims, 23 Drawing Sheets

IMAGE RECORDING APPARATUS AND IMAGE RECORDING METHOD FOR THE IMAGE RECORDING APPARATUS IMAGE

CROSS-REFERENCE TO RELATED APPLICATIONS

This application is based upon and claims the benefit of priority from prior Japanese Patent Application No. 2004-291688, filed Oct. 4, 2004, the entire contents of which are incorporated herein by reference.

BACKGROUND OF THE INVENTION

1. Field of the Invention

The present invention relates to an apparatus and method for sequentially recording images on a front and back surfaces of a recording medium.

2. Description of the Related Art

A double-side image recording apparatus is commonly known, which records images on both the front and back surfaces of a recording medium. The double-side image recording apparatus has one image recording section and a conveying mechanism that can turn a recording medium upside down. The apparatus records an image on the front surface (first surface) of recording medium and then conveys the recording medium to a reversing path. The recording medium is turned upside down and re-supplied to the image recording section. The apparatus then records an image on the back surface (second surface).

Such a double-side image recording apparatus has one image recording section that records images of the first and second surfaces of a recording medium. Accordingly, if the timings for conveying the recording medium in recording an image on the first surface and in recording an image on the second surface through re-supply are not optimally controlled, the succeeding recording medium may collide with the recording medium on a conveying path for recording media.

A possible method for preventing such a collision involves finishing recording images on the first and second surface of a recording medium before the next succeeding recording medium is supplied. Another possible method involves providing a large inter-media distance (page gap) between two successive recording media in order to prevent collision. However, these methods may reduce the number of recording that the image recording apparatus can record per unit time. This may reduce throughput to degrade the value of the image recording apparatus.

Japanese Patent No. 3084763, for example, discloses a method for determining the conveyance start timing for the succeeding recording medium in performing consecutive double-side recording. This method involves setting the number of recorded sheets in terms of pseudo pages, on the basis of the length of the sheet conveying path and sheet length and then scheduling the conveyance start timing for the succeeding recording medium. Similarly, Japanese Patent No. 3178851 discloses a method of determining conveyance start timing for recording a recording medium by calculating the number of sheets that can be left in the conveying path.

Moreover, Japanese Patent No. 3068595 discloses a method, in which the number of insertions equal to the maximum number of sheets to be recorded on the first surface is calculated from the length of the sheet conveying path and the sheet length and the conveyance start timing for the recording medium is controlled on the basis of the calculation.

Japanese Patents Nos. 3084763, 3178851, and 3068595 predetermine the conveyance start timing for a recording medium from the length of the sheet conveying path and the sheet length. Thus, the image recording apparatuses may fail to schedule the conveyance start timing for the recording medium in real time, depending on when job information on image recording (image data, double-side/single-side recording instruction, recording medium media size instruction, recorded sheet number instruction, and the like) is received from a superordinate apparatus.

Further, if single-side recording and double-side recording are consecutively performed, the methods disclosed in the prior art cannot schedule the optimum conveyance start timing for each recording medium.

BRIEF SUMMARY OF THE INVENTION

An image recording apparatus in accordance with the present invention comprises: a supply section which separates one recording medium from others and which then conveys the recording medium via a supply path, an image recording section which records an image on the recording medium, a re-supply section which re-supplies and conveys the recording medium with the image recorded on a first surface, that is, a front surface by the image recording section, to the image recording section in order to record an image on a second surface, that is, a back surface, a registration section disposed upstream of the image recording section in the supply path and which carries out at least registration on the recording medium conveyed by the supply section or re-supply section, a conveying mechanism provided opposite the image recording section and having at least a conveyance-information generating section which generates information on conveyance of the recording medium, a housing section in which the recording medium with the image recorded only on the first surface or the recording medium with the images recorded on the first and second surfaces is conveyed for housing, a reversing path section having a reversing mechanism which conveys the recording medium with the image recorded on the first surface by the image recording section, and a control section which controls at least operations for conveying the recording medium, wherein the control section sets a value for a page gap between the preceding recording medium and the succeeding recording medium during each conveyance of the recording medium, for each of consecutive double-side recording, consecutive single-side recording, and consecutive double- and single-side recording.

An image recording method accordance to the present invention comprises: extracting a first condition in which a plurality of recording medium are consecutively supplied and in which a leading end of the succeeding recording medium reaches a housing section while maintaining a page gap value equal to or larger than a predetermined value with respect to a time when a trailing end of the preceding recording medium passes completely through the housing section, extracting a second condition in which the preceding recording medium and the succeeding recording medium are not present at the same time at a recording medium supply position upstream of an image recording section which records an image on the recording medium and in which the leading end of the succeeding recording medium reaches the supply position while maintaining a page gap value equal to or larger than a predetermined value with respect to a time when the trailing end of the preceding recording medium passes completely through the supply position, extracting a third condition in which the preceding recording medium and the succeeding recording medium are not present at the same time at a reversing path section which turns recording medium upside down so that a second surface, that is, a back surface, faces upward instead of a first surface, that is, a front surface and in which the leading end of the succeeding recording medium reaches the position of the reversing path section while maintaining a page gap value equal to or larger than a predetermined value with respect to a time when the trailing end of the preceding recording medium passes completely through the position of the reversing path section, and for single-side recording in which an image is recorded only on the first surface, that is, the front surface of the recording medium, determining a conveyance start timing for the succeeding recording medium on the basis of scheduling which meets the extracted first and second conditions and for double-side recording in which an image is recorded on both sides of the recording medium including the first surface, that is, the front surface, and a second surface, that is, a back surface, determining the conveyance start timing for the succeeding recording medium on the basis of scheduling which meets the extracted first, second, and third conditions.

DETAILED DESCRIPTION OF THE INVENTION

An embodiment of the present invention will be described below with reference to the drawings.

Figure 1:
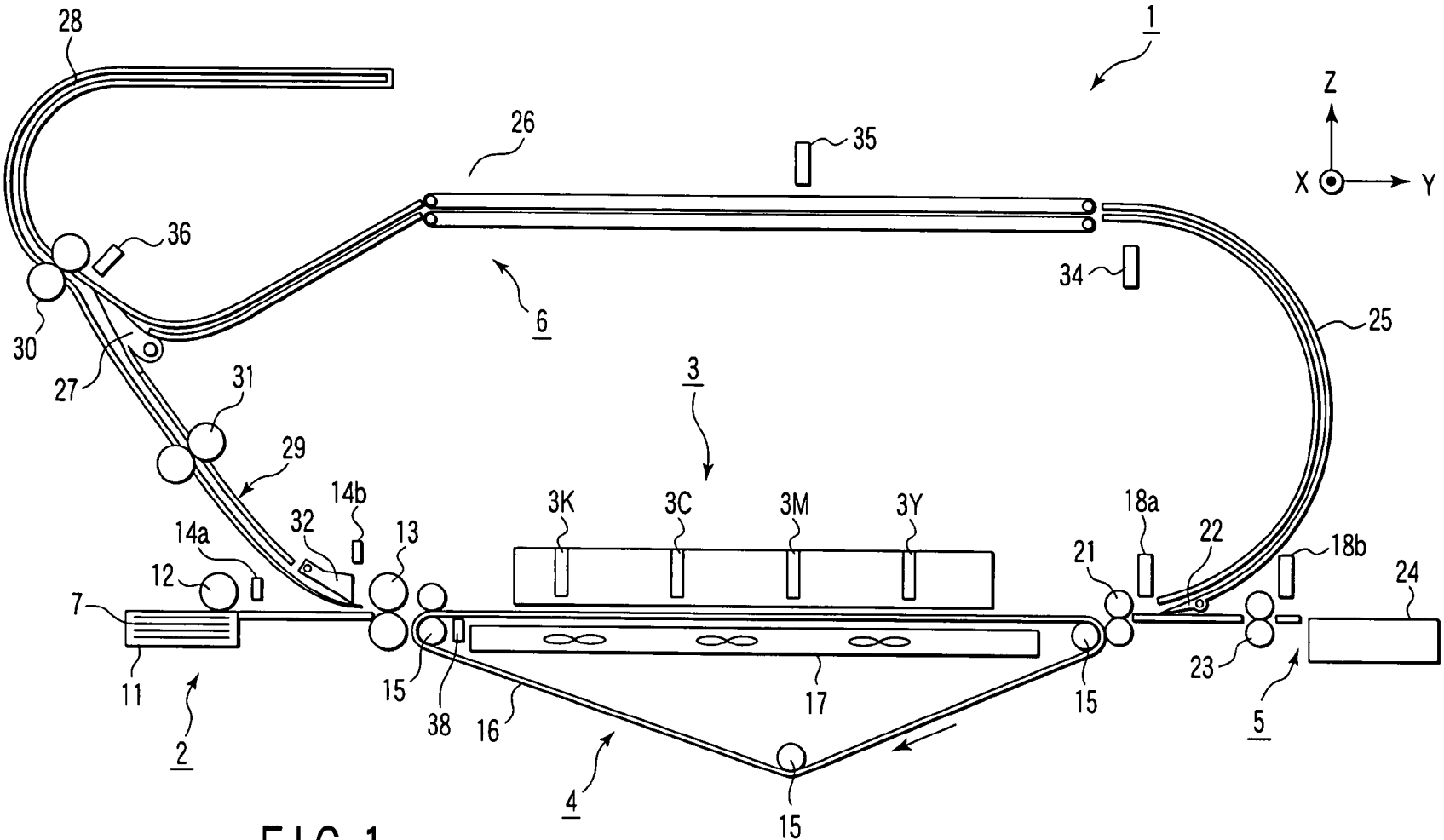
FIG. 1 is a diagram schematically showing the configuration of an image recording apparatus according to an embodiment of the present invention.
Figure 2:
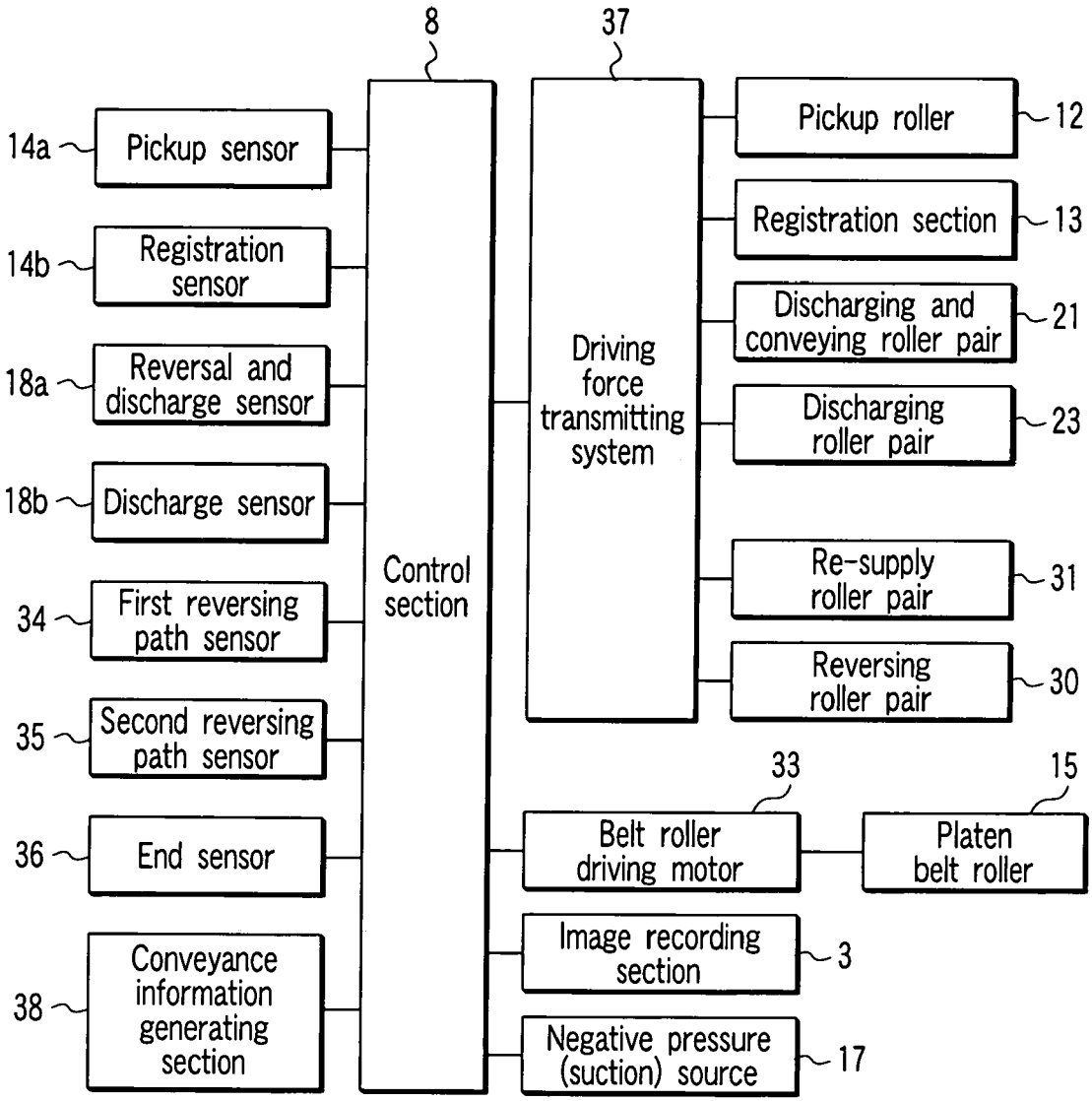
FIG. 2 is a block diagram of the image recording apparatus shown in FIG. 1.

FIG. 1 is a side view schematically showing the configuration of an image recording apparatus in accordance with the present invention. FIG. 2 is a block diagram of the image recording apparatus. In the description below, the direction in which recording medium is conveyed corresponds to an X axis direction or a sub-scanning direction. A direction orthogonal to the conveying direction corresponds to a Y axis direction or a main scanning direction or the width direction of recording medium. A direction orthogonal to an XY plane in the X and Y axis directions corresponds to a Z axis direction or a vertical direction.

As FIG. 1 shows, an image recording apparatus 1 comprises a supply section 2, an image recording section 3, a conveying mechanism 4, a housing section 5, a reversing path section 6, and a control section 8 (shown in FIG. 2). The supply section 2 supplies a recording medium 7. The conveying mechanism 4 is opposed to the image recording section 3 and has a conveyance-information generating section 38, which generates information about the conveyance of the recording medium 7. On the conveying mechanism 4, the recording medium 7 is placed to be conveyed. The housing section 5 holds the recording medium 7 in it. The control section 8 controls the whole apparatus including sensors and a driving section.

The supply section 2 has a supply tray 11, a pickup roller 12, and a registration section (referred to as a registering roller pair) 13 that directionally registers the recording medium 7. The supply tray 11 can hold a plurality of recording media 7. The pickup roller 12 picks up recording media from the supply tray 11 one by one. The registering roller pair 13 directionally registers the recording medium 7. The supply section 2 constitutes a supply path for the recording medium 7. In the present embodiment, the registering roller pair 13 constitutes a supply position from which a recording medium 7 is supplied to the image recording section 3. Further, an example of the recording medium 7 is a cut sheet in the present embodiment. The registering roller pair 13 registers the recording medium 7, eliminating inclination in the direction in which the recording medium 7 is conveyed. The registering roller pair 13 nips and conveys the registered recording medium 7 to the image recording section 3.

On the supply path, a pickup sensor 14*a* and a registration sensor 14*b* are arranged between the pickup roller 12 and the registering roller pair 13. The sensors are, for example, optical sensors that detect the presence (passage) of the recording medium 7. The result of the detection is transmitted to the control section 8.

The image recording section 3 comprises, for example, a plurality of recording heads. The recording heads can eject respective color inks to record a color image. The recording heads are, for example, four recording heads (3K (black), 3C (cyan), 3M (magenta), and 3Y (yellow)) arranged in the X axis direction at predetermined intervals. The control section 8 controls the four recording heads on the basis of image data, causing the heads to record an image on the recording medium 7.

The conveying mechanism 4 has an annular platen belt 16 passed around, for example, three platen belt rollers 15. A driving section (motor; not shown) drives one of these rollers, which moves the platen belt 16.

A conveyance-information generating section 38 is provided at one of the platen belt rollers 15 located upstream in the direction in which the recording medium 7 is conveyed. The section 38 generates information on conveyance of the recording medium 7. The generating section 38 is composed of, for example, a rotary encoder.

A large number of holes are formed in the platen belt 16. The recording medium 7 is conveyed, passing under ink nozzles in the recording heads 3K, 3C, 3M, and 3Y, while being drawn to the platen belt 16 using a negative pressure (suction) source 17 provided under the platen belt 16 and composed of one or more fans.

The following are provided in the housing section 5 in the following order from the upstream side to downstream side of a conveying path for the recording medium 7: a discharging and conveying roller pair 21, a first path switching section 22, a discharging roller pair 23, and a housing tray 24. A driving mechanism (not shown) is provided for each of the discharging and conveying roller pair 21, the discharging roller pair 23, and the first path switching section 22. Controlled by the control section 8, the driving mechanism drives the discharging and conveying roller pair 21, the discharging roller pair 23, and the first path switching section 22. The position of the discharging and conveying roller pair 21 corresponds to an image recording completion position in the image recording section 3.

The discharging and conveying roller pair 21 receives the recording medium 7 on which an image has been recorded from the conveying mechanism 4. The discharging and conveying roller pair 21 then conveys the recording medium 7 to the first path switching section 22. In response to an instruction from the control section 8, the first path switching section 22 switches either to a reversing path section 6, described below, or to the discharging roller pair 23. The first path switching section 22 then guides the recording medium 7 to the switched side. The recording medium 7 guided to the discharging roller pair 23 by the discharging roller pair 23 is placed in the housing tray 24. The following are provided downstream of the discharging and conveying roller pair 21 in the conveying path for the recording medium 7: a reversal and discharge sensor 18*a* that detects the recording medium 7 conveyed to the reversing path section 6 or to the discharging roller pair 23 and a discharge sensor 18*b* that detects passage of the recording medium 7 through the discharging roller pair 23.

The reversing path section 6 will be described.

The reversing path section 6 is a conveying mechanism that operates if double-side recording is to be carried out on the recording medium 7. The reversing path section 6 turns upside down the recording medium 7 on which a first image has been completely recorded (first surface) so that its unrecorded surface (second surface) lies opposite the image recording section 3. The reversing path section 6 then conveys the recording medium 7 to the image recording section 3 again. The reversing path section 6 comprises at least a first conveying path 25, a second conveying path 26, a second path switching section 27, and a reversing mechanism 28.

The recording medium 7 guided by the first path switching section 22 is conveyed to the reversing mechanism 28 through the first conveying path 25, the second conveying path 26, and the second switching section 27. Each of the first and second conveying paths 25 and 26 is composed of a conveying mechanism that conveys the recording medium 7 by nipping the recording medium 7 using, for example, two belts movably provided opposite to each other or to a belt and a roller.

Further, a first reversing path sensor 34 is provided in the first conveying path 25. A second reversing path sensor 35 is provided in the second conveying path 26. These sensors detect errors (paper jam and the like) in conveyance of the recording medium 7. Only the two sensors are described in connection with the image recording apparatus in accordance with the present embodiment. However, more sensors may be provided on the conveying path for the recording medium 7 as required, to detect errors in conveyance of the recording medium 7.

The second path switching section 27 has one end supported by a shaft so that its tip portion can be rotated. The second path switching section 27 is normally urged by an elastic member such as a spring to close the conveying path extending to the reversal mechanism 28. When the recording medium conveyed from the second conveying path 26 abuts against the second path switching section 27, the conveying force and weight of the recording medium 7 push the tip of the second path switching section 27 open. After the recording medium 7 has passed through, the tip of the second path switching section 27 is closed again. Once the recording medium 7 is conveyed to the reversing mechanism 28, the reversing roller pair 30 is reversely rotated, conveying the recording medium 7 in a direction reverse to the conveying direction. The recording medium 7 is then guided to a re-supply section 29, described below, through the closed second path switching section 27. The second path switching section 27 has an end sensor 36. The end sensor 36 detects an end of the recording medium 7 after it passes through the second path switching section 27 and before it is housed in the reversing mechanism 28. The end sensor 36 detects that the recording medium 7 has been housed in the reversing mechanism 28 and is ready to be guided to the re-supply section 29.

A re-supply roller pair 31 and a floating detecting mechanism 32 are disposed in the re-supply section 29 in this order from the upstream side to downstream side of the conveying path for the recording medium 7, the floating detecting mechanism 32 has a floating detecting sensor 14*b* that detects floating of the recording medium 7 during conveyance. The floating detecting mechanism 32 has one end supported by a shaft so that its tip portion may be rotated. The floating detecting mechanism 32 uses an elastic member such as a spring to urge the recording medium 7 toward the conveying path to prevent the recording medium 7 from floating. A driving mechanism (not shown) is provided for each of the re-supply roller pair 31 and floating detecting mechanism 32 to drive them under the control of the control section 8.

When the recording medium 7 is guided to the re-supply section 29, the re-supply roller pair 31 supplies the recording medium 7 to the registering roller pair 13 through the floating detecting mechanism 32, and the recording medium 7 abuts against the registering roller pair 13. The recording medium 7 having abutted against the registering roller pair 13 is registered, eliminating the inclination from the direction in which the recording medium 7 is conveyed, as in the case of the recording medium 7 taken out of the supply tray 11 in the supply section 2.

Subsequently, the image recording section 3 records an image on an image-unrecorded surface (second surface) of the recording medium 7. The discharging roller pair 23 then houses the recording medium 7 in the housing tray 24.

Figure 8:
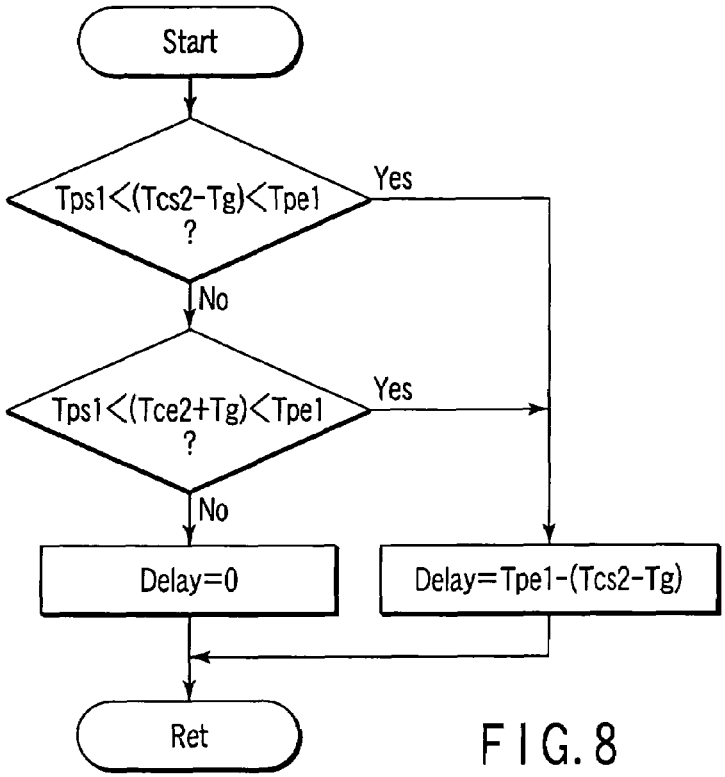
FIG. 8 is a flowchart showing a third subroutine in the second subroutine in FIG. 5.

The control section 8, shown in FIG. 8, comprises CPU, a timer, ROM, and RAM. The control section 8 connects to each of the rollers via a driving force transmitting system 37. The driving force transmitting system 37 connects to the pickup roller 12, the registering roller 13, the discharging and conveying roller 21, the discharging roller pair 23, the reversing roller pair 30, the re-supply roller pair 31, and the like. A driving force is transmitted to each of the rollers for driving in accordance with an instruction from the control section 8. The control section 8 drives a belt roller driving motor 33, rotating the platen belt rollers 15.

Moreover, a detection signal from each sensor is input to the control section 8 in order to determine a timing for starting conveying the recording medium 7 as described below. The following sensors are mainly used for conveyance start timings: the pickup sensor 14*a*, the registration sensor 14*b*, the reversal and discharge sensor 18*a*, and the discharge sensor 18*b*.

The control section 8 has the following sensors that detect the recording medium 7 present in the reversing path section 6: the first reversing path sensor 34, disposed in the first conveying path 25, the second reversing path sensor 35, disposed in the second conveying path 26, and the end sensor 36, disposed in the reversing mechanism 28. The control section 8 has a scheduling section (CPU) for scheduling which determines a timing for starting conveying the recording medium 7 as described below.

Now, a detailed description will be given of operations of the image recording apparatus configured as described above.

First, the control section 8 drives the pickup roller pair 12, which picks up the recording medium 7 from the supply tray 11 one by one. The control section 8 then conveys the recording medium 7 to the registration roller pair 13. On this occasion, the control section 8 uses the pickup sensor 14*a* to detect the recording medium 7 to confirm the passage of the recording medium 7. To record images consecutively on a plurality of recording medium 7, the control section 8 determines a timing of allowing the pickup roller pair 12 to start conveying the recording medium 7 in accordance with scheduling based on job information on image recording. (The job information includes image data, double-side/single-side recording instruction, recording medium size instruction, and recorded sheet number instruction, and the like.)

The control section 8 can adjust the distance (page gap) between the conveyed recording media by changing the conveyance start timing for the recording medium 7. The control section 8 abuts the recording medium 7 picked up by the pickup roller pair 12, against the stopped registration roller pair 13, to loop the recording medium 7. At this time, the control section 8 starts driving the platen belt 16 of the conveying mechanism 4 to allow the conveying information generating section 38 to generate information on conveyance of the recording medium 7.

A predetermined time later, the control section 8 starts rotating the registration roller pair 13 to register the recording medium 7 so as to eliminate its inclination in the direction in which the recording medium 7 is conveyed (skewing in the conveying direction). The control section 8 then delivers the recording medium 7 to the platen belt 16 of the conveying mechanism 4.

Then, the control section 8 moves the recording medium 7 under the nozzles in the recording heads 3K, 3C, 3M, and 3Y, with the recording medium 7 sucked to the moving platen belt 16 by negative pressure exerted by the negative pressure source 17. On the basis of image data contained in the job information from the superordinate apparatus, the control section 8 allows the recording heads 3K, 3C, 3M, and 3Y to eject the respective color inks through the nozzles while the recording medium 7 is being moved under the nozzles in the recording heads.

The control section 8 determines ink ejection timings for the recording heads 3K, 3C, 3M, and 3Y on the basis of, for example, the predetermined number of pulses from a rotary encoder in the information generating section 38.

If the control section 8 has received a single-side recording instruction in the job, information, it drives the discharging and conveying roller 21 and raises the tip of the first path switching section 22. The control section 8 further drives the discharging roller pair 23 to convey the recording medium 7 with an image recorded on one surface (first surface) to the housing section 5.

If the control section 8 has received a double-side recording instruction in the job information, it drives the discharging and conveying roller 21 and lowers the tip of the first path switching section 22. The recording medium 7 thus abuts against the discharging path and is then guided to the reversing path section 6.

When the recording medium 7 is guided to the reversing path section 6, the control section 8 passes the recording medium 7 through the first conveying path 25, second conveying path 26, and second path switching section 27 in the reversing path section 6. The reversing mechanism 28 turns the recording medium 7 upside down and then stops it. On this occasion, the recording medium 7 has its trailing end nipped by the reversing roller pair 30.

Further, the control section 8 uses the first reversing path sensor 34, the second reversing path sensor 35, and the end detecting sensor 36 to determine how the recording medium 7 has passed through the first conveying path 25, the second conveying path 26, and the second path switching section 27.

If the recording medium 7 fails to pass through the corresponding path a predetermined time later, the control section 8 determines that an error is occurring in which the recording medium 7 is caught at a certain position. The control section 8 then executes an error process (stopping a conveying system and alarming a user for the error) and stops the image recording process.

Then, the control section 8 reversely rotates the reversing roller pair 30 to convey the recording medium 7 in the direction reverse to that in which the recording medium 7 was conveyed. The recording medium 7 has its trailing end nipped by the reversing mechanism 28. The recording medium 7 is thus drawn out from the reversing mechanism 28 and conveyed to the re-supply section 29 via the second switching section 27.

The control section 8 uses the re-supply roller pair 31 in the re-supply section 29 to nip and convey the recording medium 7. The recording medium 7 passes through the floating detecting mechanism 32 and abuts it against the registering roller pair 13.

The control section 8 drives the registering roller pair 13 to register the recording medium 7 again. The inclination of the medium 7 (i.e., skewing in the conveying direction) is thereby eliminated, as in the case of the recording medium 7 taken out of the supply tray 11.

Subsequently, the control section 8 conveys the recording medium 7, which passes from the registering roller pair 13 to the platen belt 16 of the conveying mechanism 4. The image recording section 3 then records an image on the image unrecorded surface (second surface) of the recording medium 7.

The control section 8 allows the discharging and conveying roller pair 21 to nip and convey the recording medium 7 with the image recorded on its surface. The recording medium 7 thus passes under the first path switching section 22 with its tip raised.

After the recording medium 7 passes under the first path switching section 22, the control section 8 allows the discharging roller 23 to further nip and convey the recording medium 7. The recording medium 7 is then housed in the housing tray 24 in the housing section 5 to complete the image recording process.

Now, description will be given of scheduling that determines a conveyance start timing for the recording medium when double-side recording is carried out on the recording medium according to the present embodiment.

If the job information specifies, for example, double-side recording of one recording medium 7, the control section 8 passes the recording medium 7 through each of the registering roller pair 13 and image recording section 3 twice as previously described. Images are thus recorded on both front and back surfaces of the recording medium 7. The medium 7 recorded is conveyed to the discharging roller pair 23 and housed in the housing tray 24.

If the job information specifies, for example, double-side recording of a plurality of recording medium 7, the control section 8 supplies and conveys the recording medium 7 from the supply section 2. First, the recording medium 7 passes through the registering roller pair 13 and is conveyed to the image recording section 3 for record on the front surface (first surface) of the recording medium 7. Then, to record an image on the back surface (second surface) of the recording medium 7, the control section 8 allows the reversing path section 6 and re-supply section 29 to convey the recording medium 7 with the image already recorded on the front surface (first surface). The recording medium 7 passes through the registering roller pair 13 and is conveyed to the image recording section 3 again.

A plurality of recording medium 7 may be consecutively conveyed to the image recording section 3 so that the conveying operation is performed twice on each recording medium 7. In this case, the control section 8 must perform such control as prevents succeeding recording medium **7*b* from colliding against preceding recording medium 7*a* or prevents the recording medium 7*a* and 7*b* from being conveyed without ensuring a predetermined gap between the preceding recording medium 7*a* and the succeeding recording medium 7*b***.

Further, to increase the number of sheets recorded by the image recording apparatus per unit time (to improve throughput), the control section 8 must set the predetermined page gap between the preceding recording medium **7*a* and the succeeding recording medium 7*b* at the minimum required value. The control section 8 must also carry out scheduling which determines conveyance start timings for conveyance of the recording medium 7 from the supply section 2 and from the re-supply section 29**.

The scheduling for determining a conveyance start timing for the recording medium to achieve consecutive single-side recording, consecutive double-side recording, or consecutive single- and double-side recording will be described in detail, with reference to the timing charts in FIGS. 3 to 10 and 11 to 33.

In the description below, the flowcharts in FIGS. 3 to 10 and the timing charts in FIGS. 11 to 33 illustrate the same contents. Accordingly, FIGS. 3 to 10 will be described in brief, and the description below will be given with reference only to the timing charts in FIGS. 11 to 33.

Figure 3:
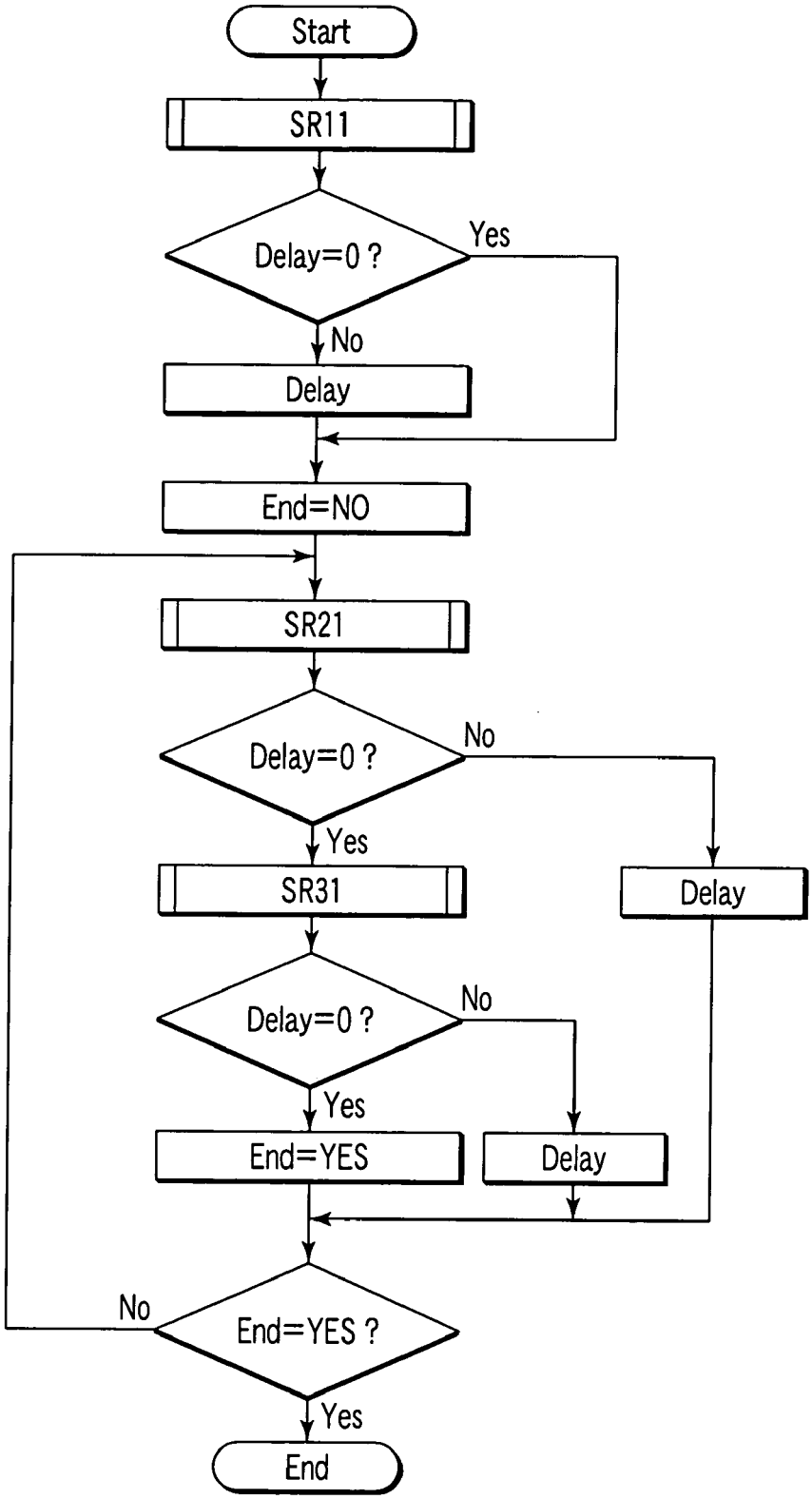
FIG. 3 is a flowchart showing a scheduling main routine for determining a timing for starting the conveying of a recording medium.
Figure 4:
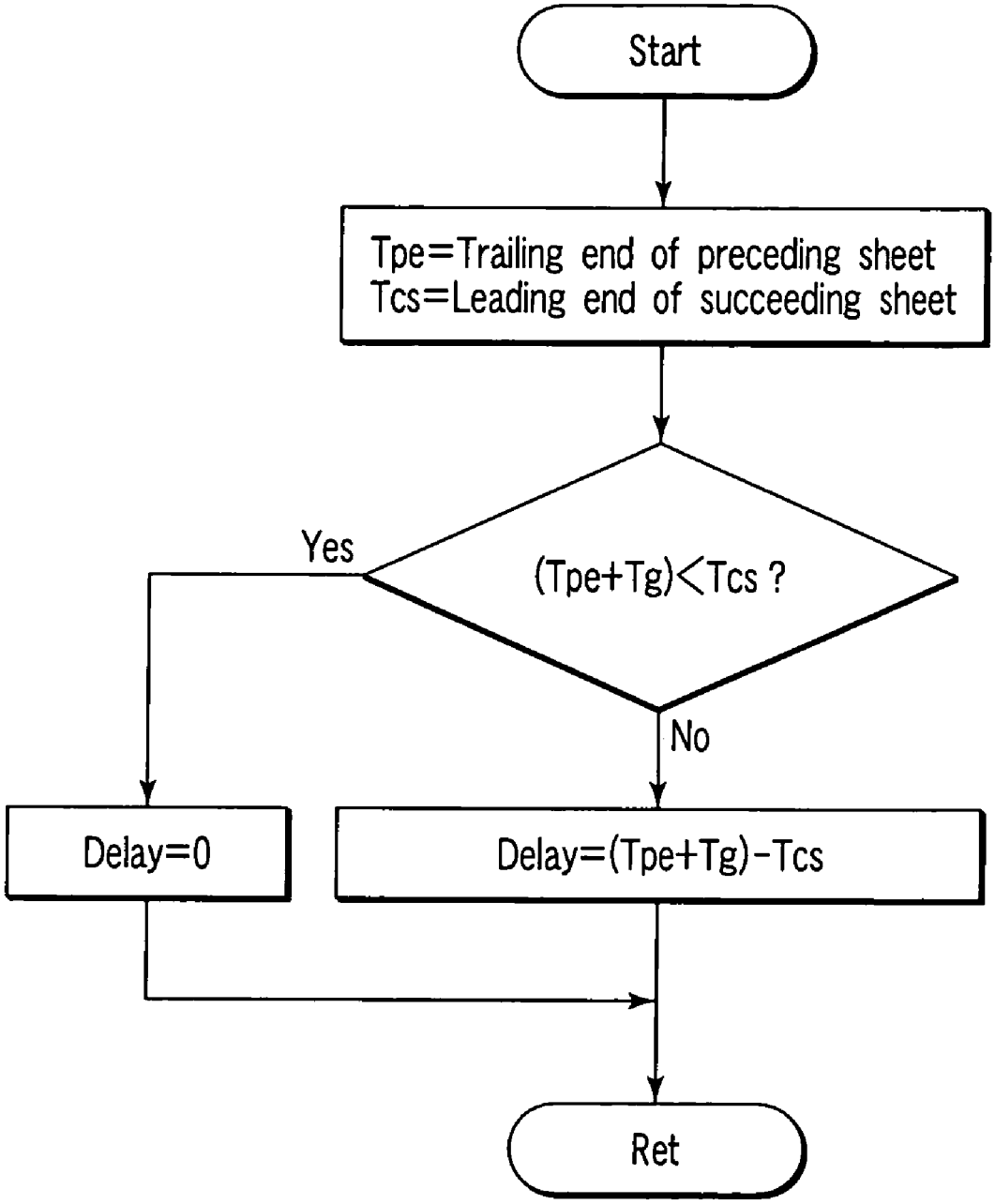
FIG. 4 is a flowchart showing a first subroutine in the scheduling main routine in FIG. 3.
Figure 5:
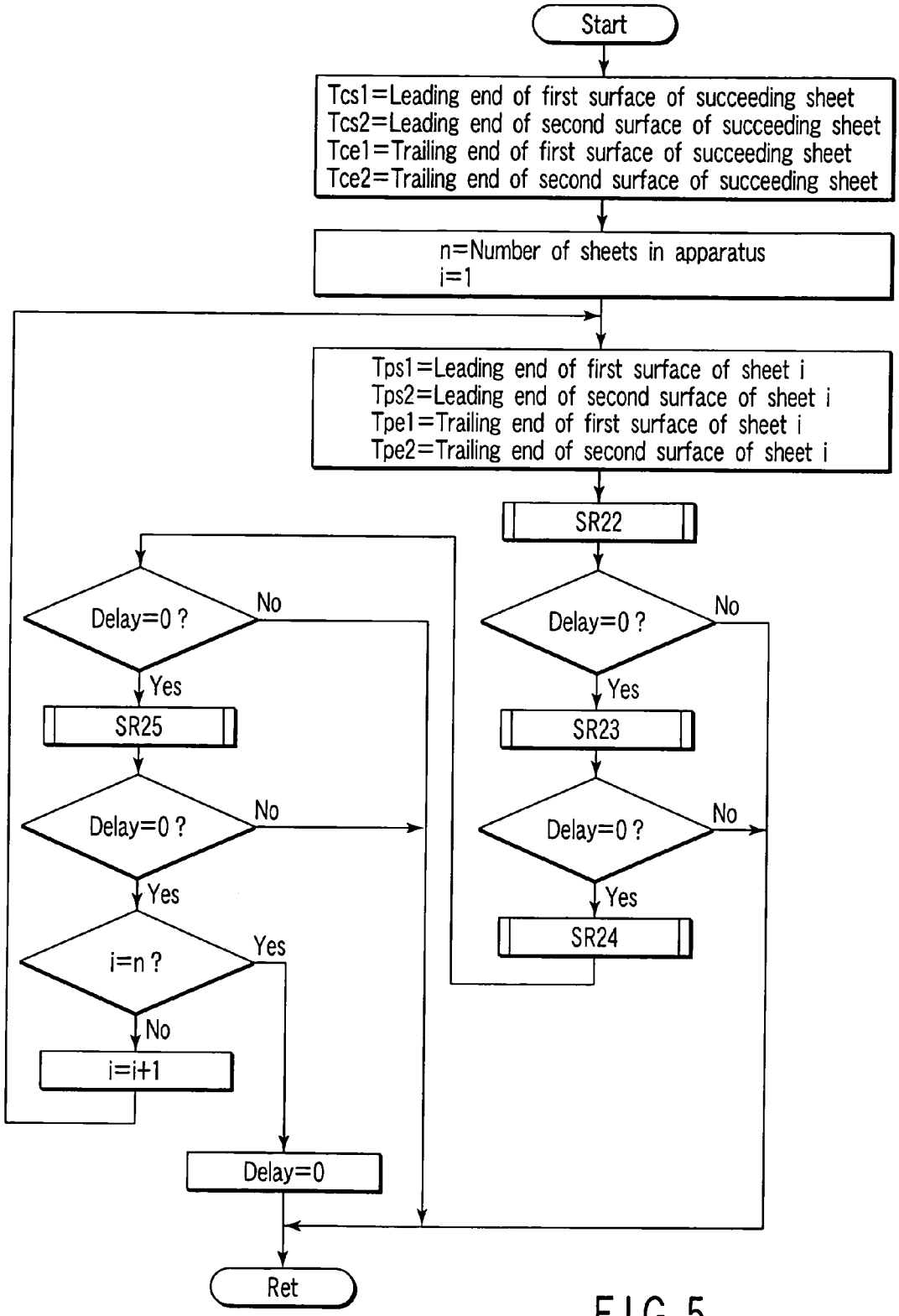
FIG. 5 is a flowchart showing a second subroutine in the scheduling main routine in FIG. 3.
Figure 6:
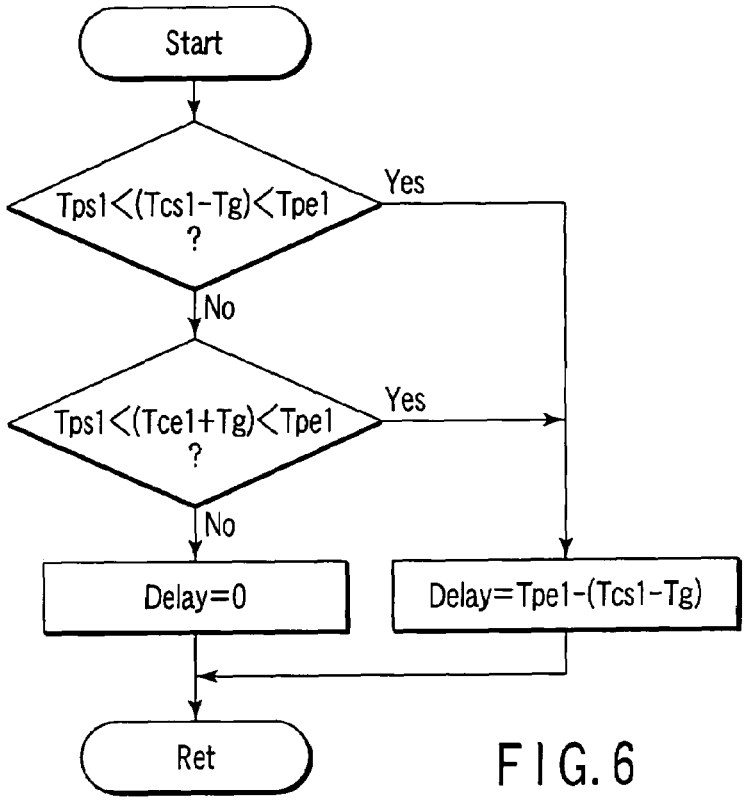
FIG. 6 is a flowchart showing a first subroutine in a second subroutine in FIG. 5.
Figure 7:
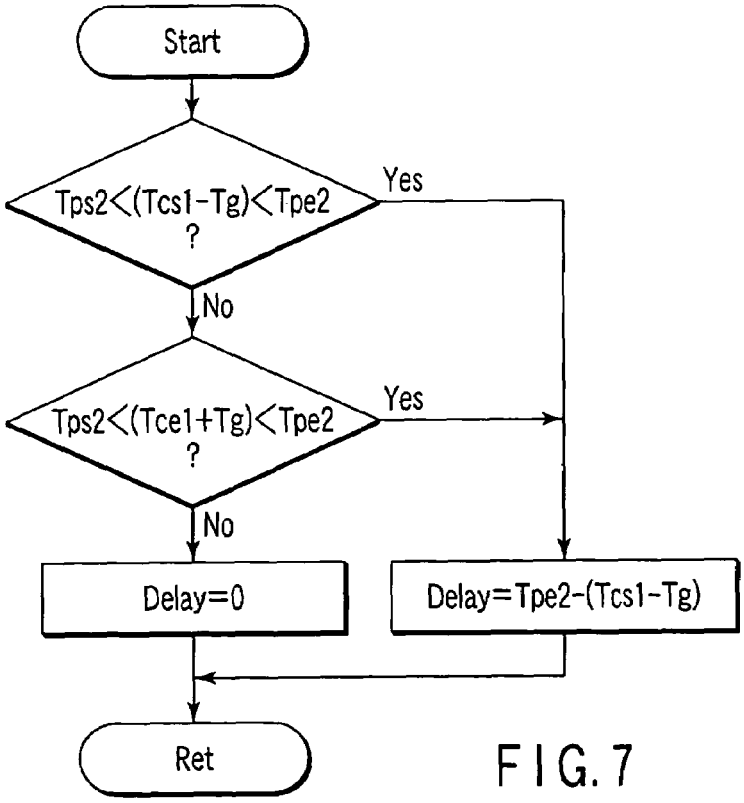
FIG. 7 is a flowchart showing a second subroutine in the second subroutine in FIG. 5.
Figure 9:
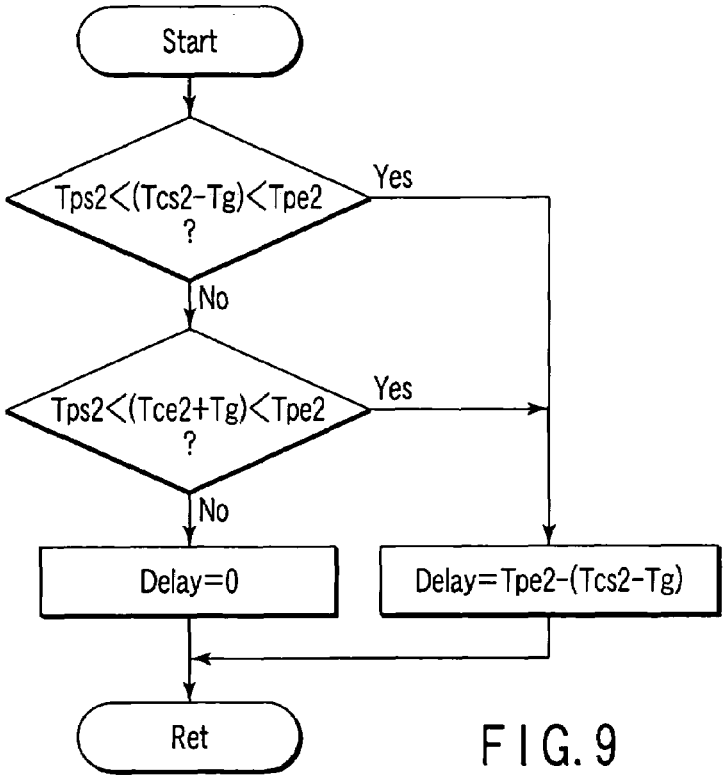
FIG. 9 is a flowchart showing a fourth subroutine in the second subroutine in FIG. 5.
Figure 10:
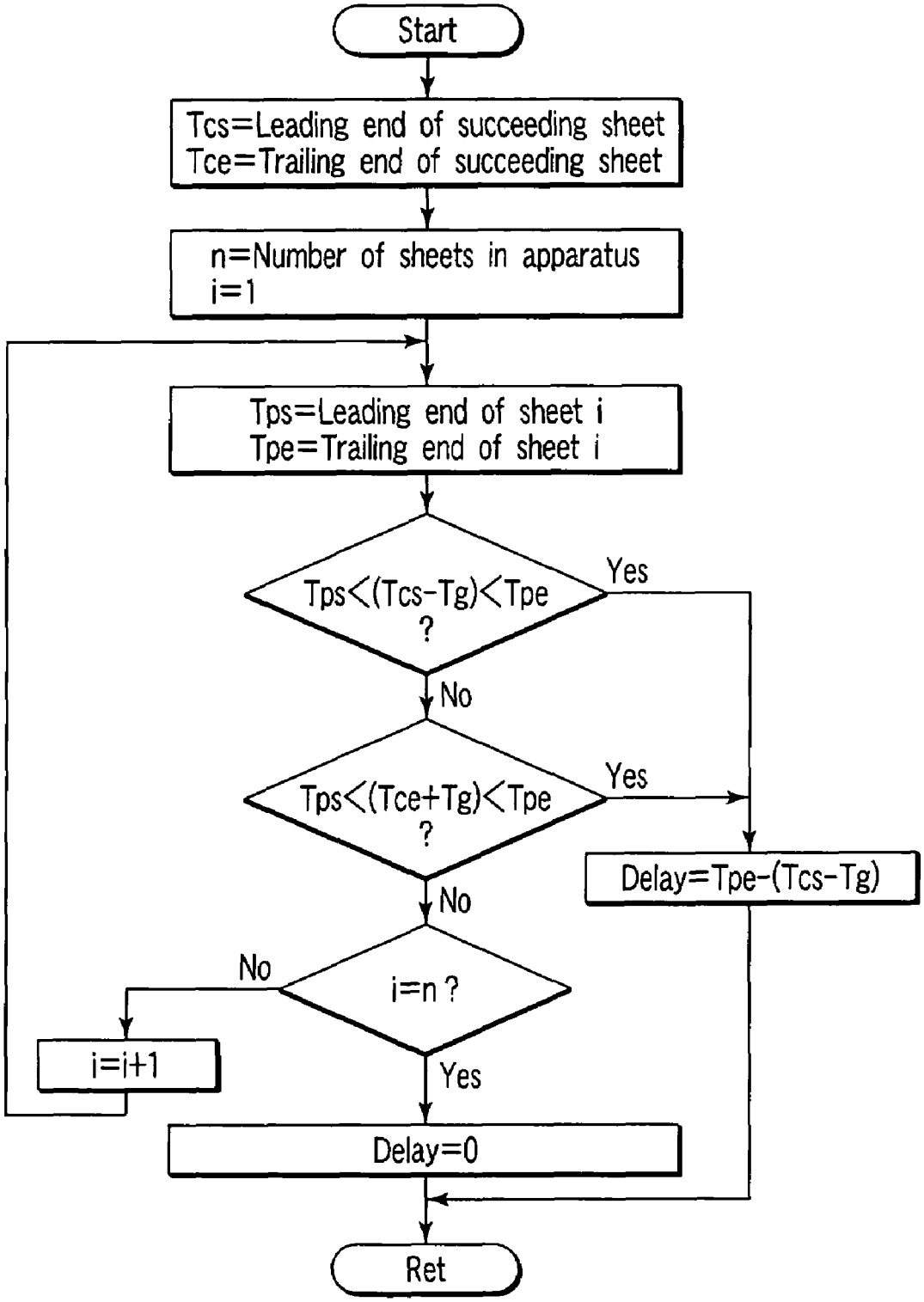
FIG. 10 is a flowchart showing a third subroutine in the scheduling main routine in FIG. 3.

FIG. 3 is a flowchart showing an example of a scheduling main routine for determining the timing for starting conveying recording medium. FIG. 4 is a flowchart showing an example of a first subroutine in the scheduling main routine in FIG. 3. FIG. 5 is a flowchart showing an example of a second subroutine in the scheduling main routine in FIG. 3. FIG. 6 is a flowchart showing an example of a first subroutine in a second subroutine in FIG. 5. FIG. 7 is a flowchart showing an example of a second subroutine in the second subroutine in FIG. 5. FIG. 8 is a flowchart showing an example of a third subroutine in the second subroutine in FIG. 5. FIG. 9 is a flowchart showing an example of a fourth subroutine in the second subroutine in FIG. 5. FIG. 10 is a flowchart showing an example of a third subroutine in the scheduling main routine in FIG. 3.

Figure 11:
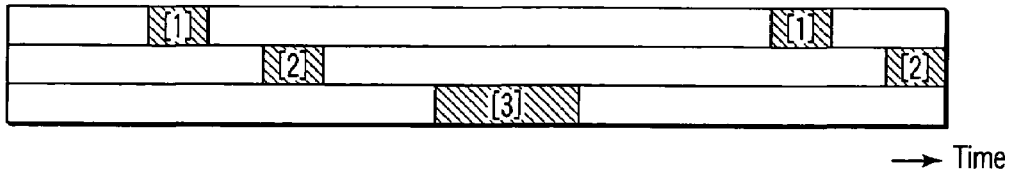
FIG. 11 is a timing chart showing an example of timing for starting the conveying of a sheet (recording medium)

FIG. 11 is a timing chart showing times [1], [2], and [3]. At the time [1], which follows a predetermined time when the registering roller pair 13 nips the leading end of the conveyed recording medium 7, the recording medium 7 passes through the registering roller pair 13. At the time [2], which follows a predetermined time when the discharging and conveying roller pair 21 nips the leading end of the conveyed recording medium 7, the recording medium 7 passes through the discharging and conveying roller pair 21. At the time [3], which follows a predetermined time when the reversing roller pair 30 nips the leading end of the conveyed recording medium 7, the recording medium 7 passes through the reversing roller pair 30.

The times of passage [1], [2], and [3] are shown in terms of cumulative values for encoder pulses generated by the rotary encoder in the conveyance-information generating section 38 of the conveying mechanism 4, previously described.

Scheduling for consecutive double-side recording will be described below using the above expressing method.

To determine a schedule for consecutive double-side recording, it is necessary to meet the following three conditions.

First condition (A): The succeeding recording medium 7 (sheet n+1) must be discharged after the preceding recording medium (sheet n). That is, the succeeding recording medium 7 must start to pass through the discharging and conveying roller pair 21 a certain time after the preceding recording medium 7 has finished passing through the discharging and conveying roller pair 21, the certain time corresponding to a predetermined page gap.

Second condition (B): To carry out scheduling on new recording medium 7, it is necessary to prevent the new recording medium 7 from passing through the registering roller pair 13 at the same time when any of the recording medium 7 being conveyed passes through the registering roller pair 13. Further, an interval equal to or longer than the time corresponding to the predetermined page gap must be provided between the time when any of the recording medium 7 being conveyed passes through the registering roller pair 13 and the time when the new recording medium 7 passes through the registering roller pair 13.

Third condition (C): To carry out scheduling on new recording medium 7, it is necessary to prevent the new recording medium 7 from passing through the reversing roller pair 30 at the same time when any of the recording medium 7 being conveyed passes through the reversing roller pair 30. Further, an interval equal to or longer than the time corresponding to the predetermined page gap between the recording medium 7 must be provided between the time when any of the recording medium 7 being conveyed passes through the reversing roller pair 30 and the time when the new recording medium 7 passes through the reversing roller pair 30.

Figure 12:
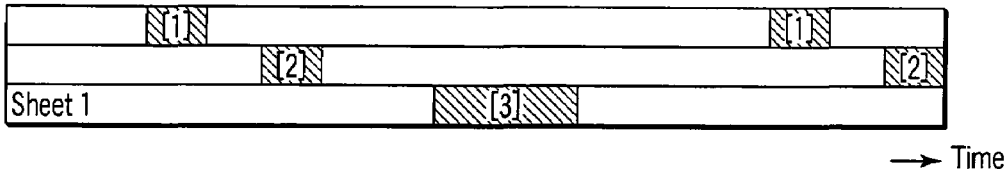
FIG. 12 is a timing chart showing the result of scheduling of a conveyance start timing for a first sheet.
Figure 13:
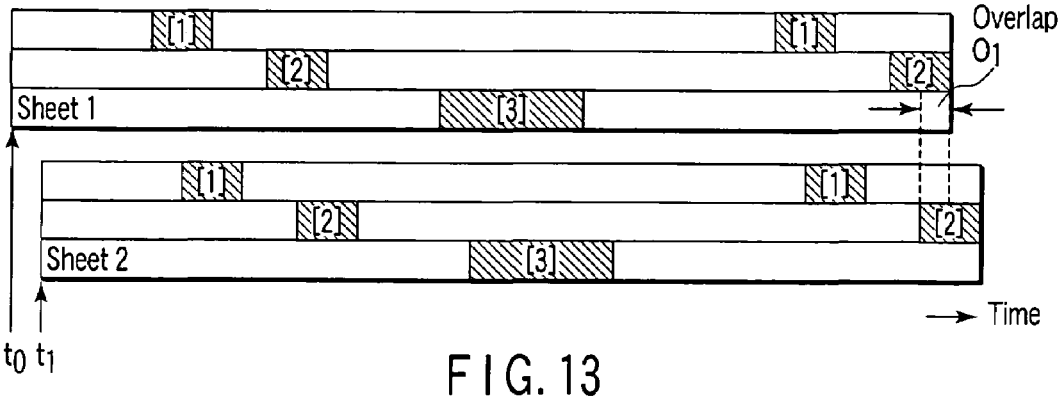
FIG. 13 is a timing chart illustrating how a conveyance start timing for a second sheet is temporarily scheduled with respect to the first sheet.

The image recording apparatus receives a double-side recording instruction for the preceding recording medium 7 (referred to as a sheet 1 below) from the superordinate apparatus having instructed the image recording apparatus to carry out consecutive recording. The image recording apparatus then schedules the conveyance start timing for the sheet 1 using the time t0 of the reception as a start point as shown in FIG. 12. The supply section 2 starts supplying the recording medium 7. Subsequently, the image recording apparatus receives a double-side recording instruction for the succeeding recording medium 7 (referred to as a sheet 2 below) from the superordinate apparatus. The image recording apparatus then temporarily schedules the conveyance start timing for the sheet 2 using the time t1 of the reception as a start point as shown in FIG. 13. However, this conveyance start timing does not meet the above condition A. Accordingly, before the sheet 1 has been discharged, the sheet 2 reaches the discharging and conveying roller 21. Thus, to meet the condition A, a time when the sheet 2 starts to be supplied is delayed to avoid the temporal overlapping of recording medium passing through the discharging and conveying roller pair 21.

Now, a detailed description will be given of a method of determining whether or not the passing preceding sheet 1 temporally overlaps the passing succeeding sheet 2 and of calculation of the amount of delay from the time to start conveyance of the sheet 2 which amount is required to avoid the overlapping.

Further, with the conveyance start timing for the sheet 1 determined, temporary scheduling is carried out on the succeeding sheet 2 using an arbitrary supply start time. This results in overlapping in which the sheet 2 enters the discharging and conveying roller pair 21 after the sheet 1 does as shown in FIG. 14A and overlapping in which the sheet 2 enters the discharging and conveying roller pair 21 before the sheet 1 does as shown in FIG. 14B.

Figure 14A:
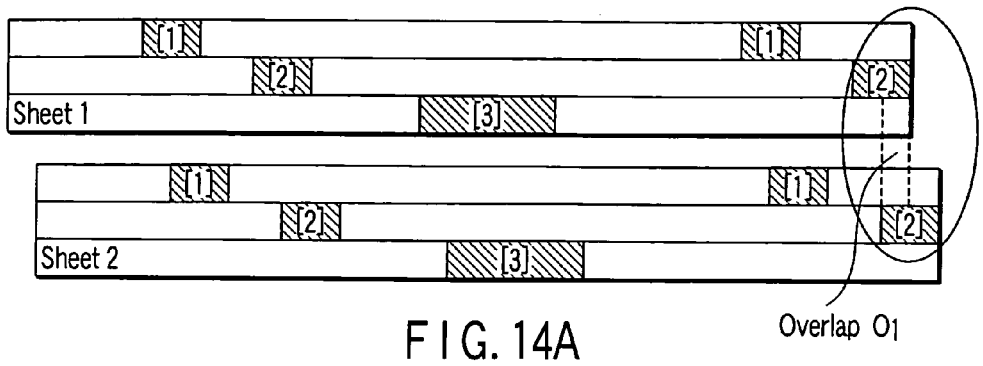
FIGS. 14A and 14B are diagrams showing how conveyed sheets overlap each other.
Figure 14B:
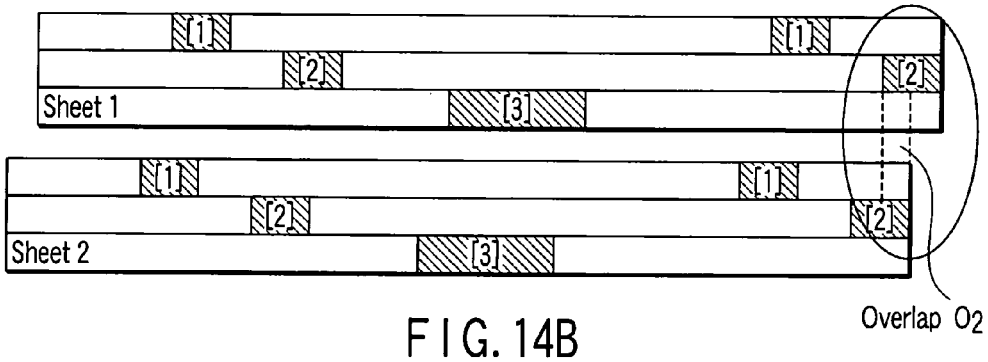
Figure 15A:
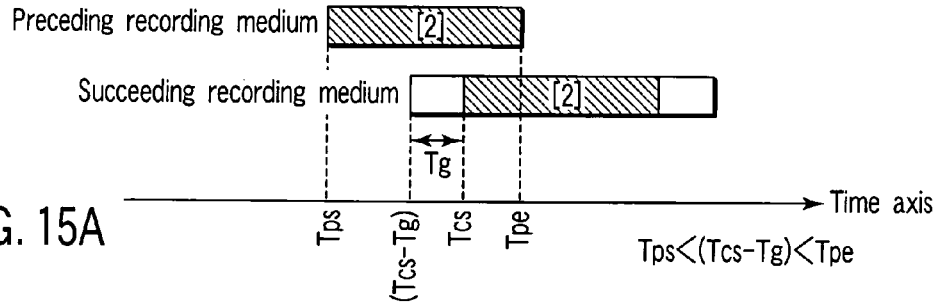
FIGS. 15A and 15B are diagrams illustrating how it is determined whether or not overlapping are occurring.

It is possible to determine whether or not the overlapping shown in FIG. 14A is occurring by checking whether or not the following condition is met as shown in FIG. 15A:

$$Tps<(Tcs-Tg)<Tpe$$

where Tps is the time when the sheet 1 is to start passing through the discharging and conveying roller pair 21, Tpe is the time when the sheet 1 is to finish passing through the discharging and conveying roller pair 21, and Tg is the time corresponding to the page gap.

Figure 15B:
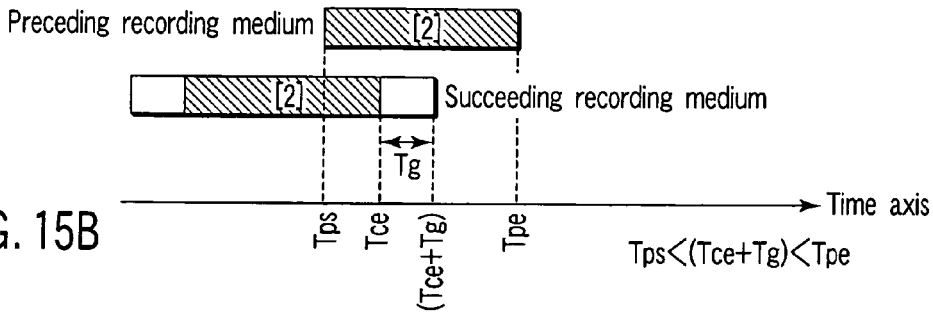

It is possible to determine whether the overlapping shown in FIG. 14B is occurring by checking whether or not the following condition is met as shown in FIG. 15B:

$$Tps<(Tce+Tg)<Tpe$$

where Tps is the time when the sheet 1 is to start passing through the discharging and conveying roller pair 21, Tpe is the time when the sheet 1 is to finish passing through the discharging and conveying roller pair 21, Tce is the time when the sheet 2 is to finish passing through the discharging and conveying roller pair 21, and Tg is denotes the time corresponding to the page gap.

Figure 16A:
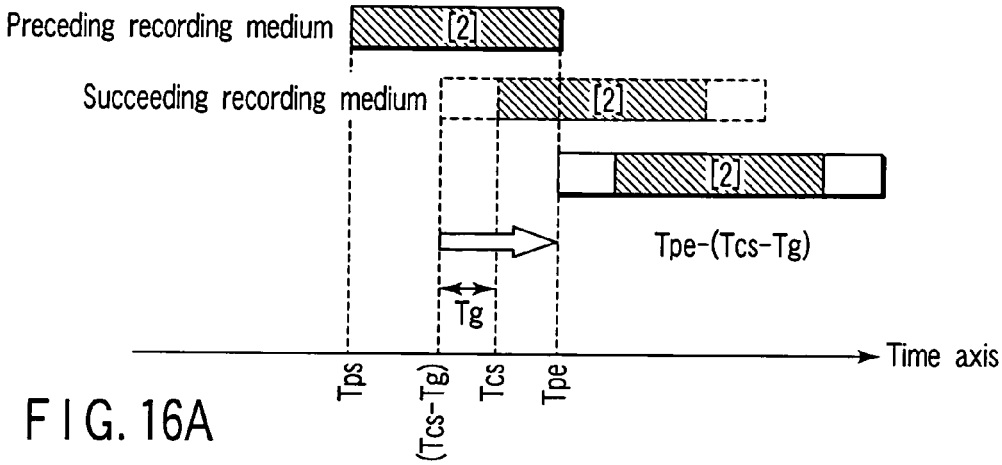
FIGS. 16A and 16B are diagrams illustrating a sheet conveyance start timing that avoids overlapping.

If overlapping O1 is occurring in which the sheet 2 reaches the discharging and conveying roller pair 21 before the sheet 1 finishes passing through the discharging and conveying roller pair 21 as shown in FIG. 14A or 15A, it can be avoided by delaying the conveyance start timing for the succeeding sheet 2 by the time (Tpe−(Tcs−Tg)) as shown in FIG. 16A.

Figure 16B:
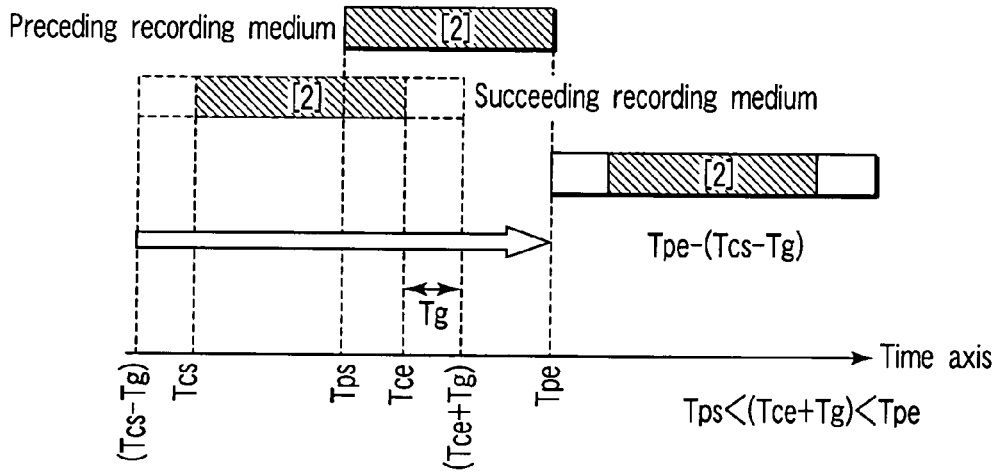

If overlapping O2 is occurring in which the sheet 2 reaches the discharging and conveying roller pair 21 before the sheet 1 does as shown in FIG. 14B or 15B, it can be avoided by delaying the conveyance start timing for the succeeding sheet 2 by the time (Tpe−(Tcs−Tg)) as shown in FIG. 16B.

Figure 17:
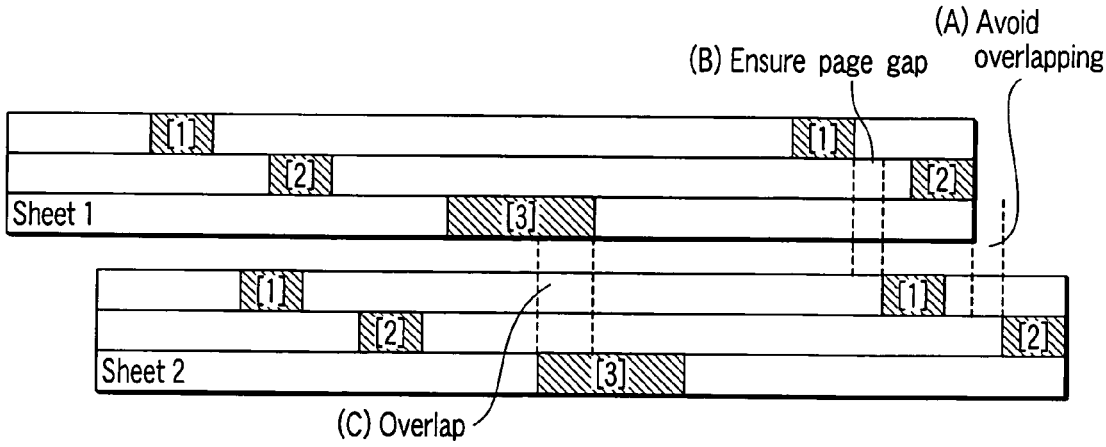
FIG. 17 is a timing chart showing that conditions A and B are met for a first and second sheets, while a condition C is not met for these sheets.

These delay operations result in a conveyance start timing for the sheet 2 as shown in FIG. 17.

Subsequently, the image recording apparatus checks whether or not the determined conveyance start timing meets the rule based on the condition B. Similarly, the values (Tpe−(Tcs−Tg)) and ((Tce+Tg)−Tps) are determined where Tps denotes the time when the preceding sheet 1 is to start passing through the registering roller pair 13, Tpe denotes the time when the preceding sheet 1 is to finish passing through the registering roller pair 13, Tcs denotes the time when the succeeding sheet 2 is to start passing through the registering roller pair 13, Tce denotes the time when the succeeding sheet 2 is to finish passing through the registering roller pair 13, and Tg denotes the time corresponding to the page gap. In this, neither value exceeds zero, indicating that for the condition B, the predetermined gap is provided between the two recording medium 7.

Subsequently, similar checks are carried out on the condition C. In this case, the value (Tpe−(Tcs−Tg)) exceeds zero where Tpe denotes the time when the preceding sheet 1 is to finish passing through the reversing roller pair 30, Tcs denotes the time when the succeeding sheet 2 is to start passing through the reversing roller pair 30, and Tg denotes the time corresponding to the page gap. This indicates that the two recording medium 7 are overlapping at the reversing roller pair 30. Thus, the conveyance start timing for the sheet 2 is delayed by the value found using the above expression.

Figure 18:
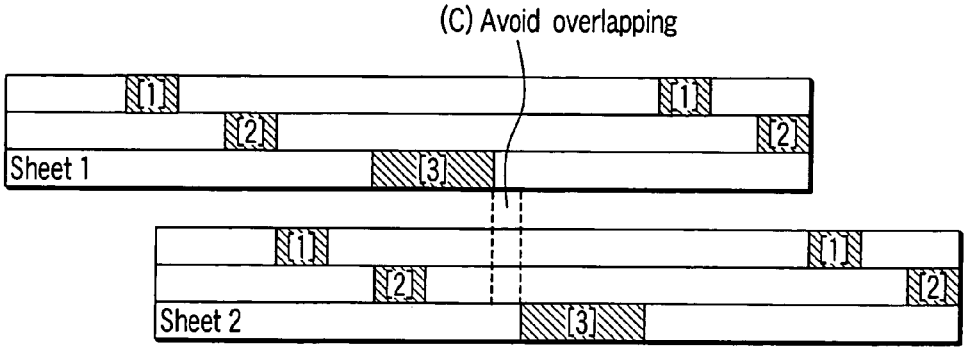
FIG. 18 is a timing chart showing that the conditions A, B, and C are met for the sheets to determine a conveyance start timing.

This delay operation results in such conveyance start timings for the two recording medium 7 as shown in FIG. 18. Consequently, the overlapping at the reversing roller pair 30 is avoided. In the above process, if even only one of the conditions A to C has not been met before a delay operation is performed, the above conditions A to C are executed again. This process is repeated until all of the three conditions are satisfied.

Figure 19:
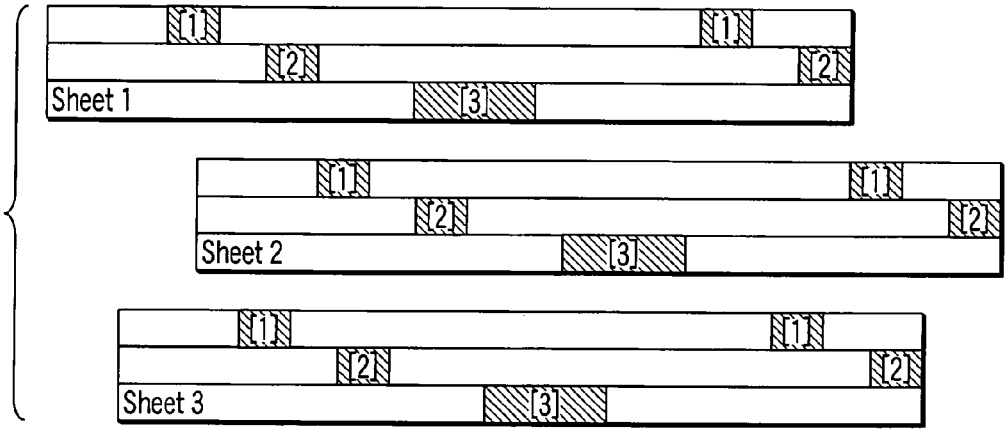
FIG. 19 is a timing chart showing that a sheet conveyance start timing for a third sheet is temporarily scheduled with respect to the first and second sheets, for which the conveyance start timing has been determined.
Figure 20:
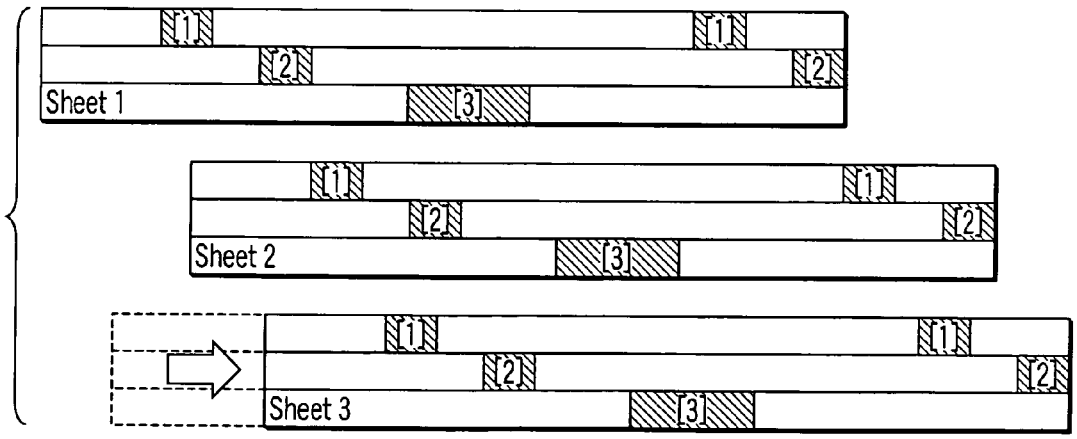
FIG. 20 is a timing chart showing that the conditions A and B are met for the third sheet, while the condition C is not met for the sheet.
Figure 21:
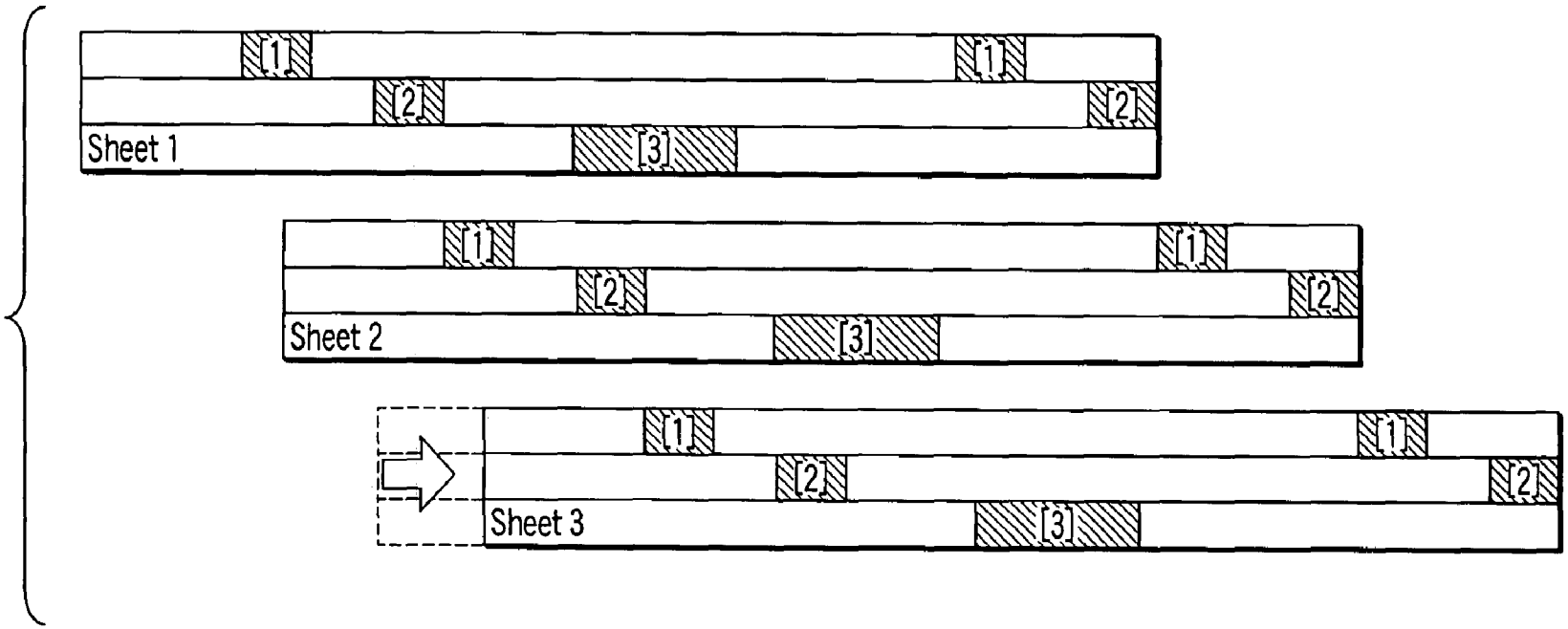
FIG. 21 is a timing chart showing that the conditions A, B, and C are met for the first, second, and third sheets to determine a conveyance start timing.

Then, the image processing apparatus receives a double-side recording instruction for the recording medium 7 (sheet 3) from the superordinate apparatus. The image recording apparatus then temporarily schedules the conveyance start timing for the sheet 3 using the time of the reception as a start point as shown in FIG. 19. Moreover, as previously described, the conveyance start timing is delayed on the basis of the condition A as shown in FIG. 20. Furthermore, the conveyance start timing is delayed on the basis of the condition C as shown in FIG. 21. As a result, the schedule for the sheet 3 is determined.

Figure 22:
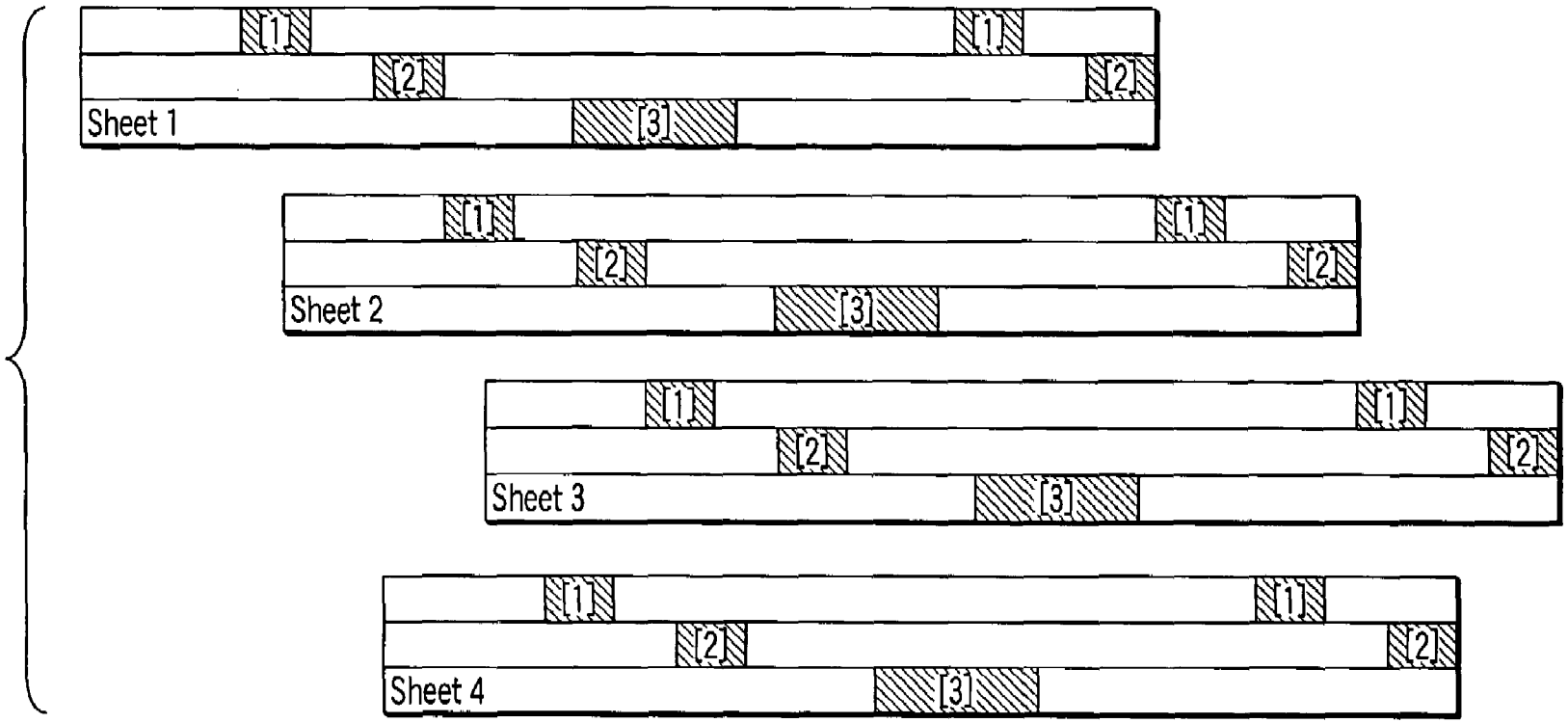
FIG. 22 is a timing chart showing that a sheet conveyance start timing for a fourth sheet is temporarily scheduled with respect to the first, second, and third sheets, for which the conveyance start timings have already been established.
Figure 23:
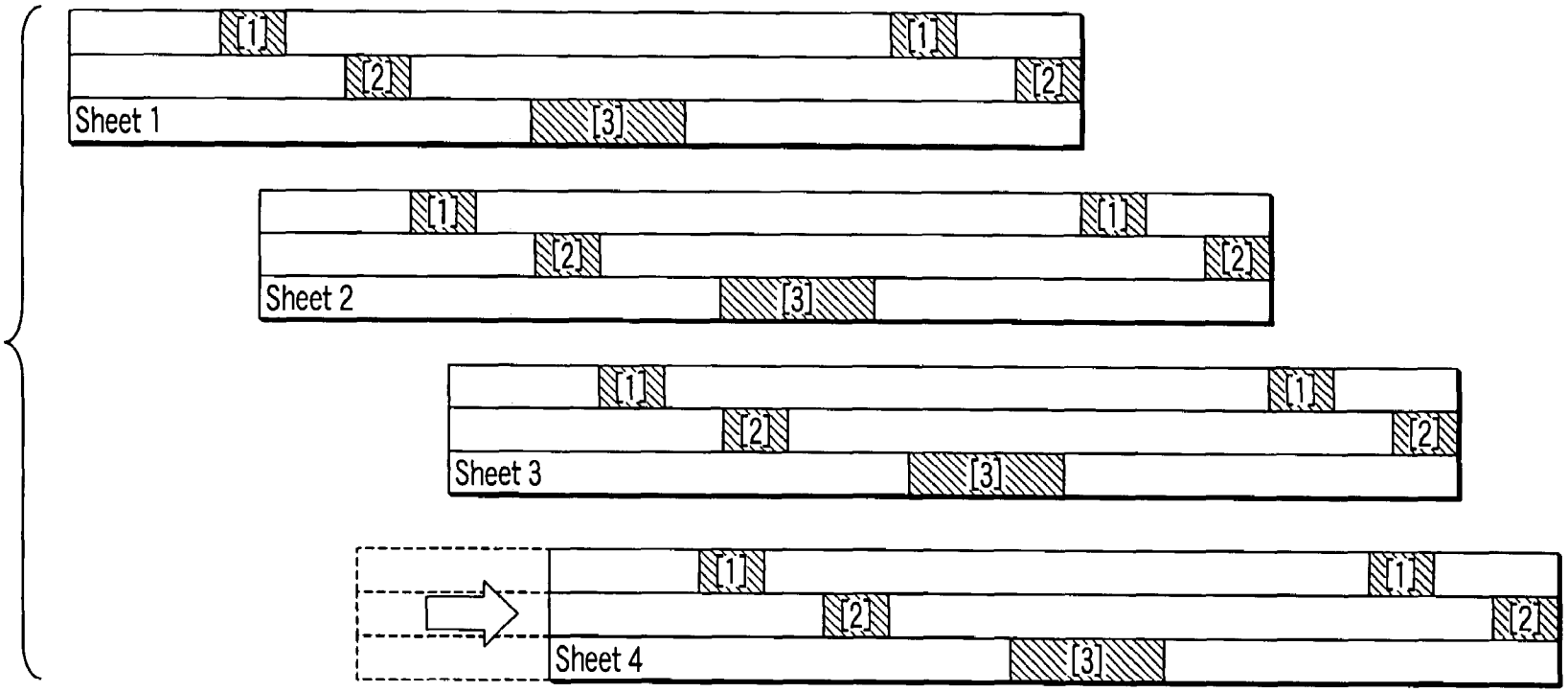
FIG. 23 is a timing chart showing that the conditions A and B are met for the fourth sheet, while the condition C is not met for the sheet.
Figure 24:
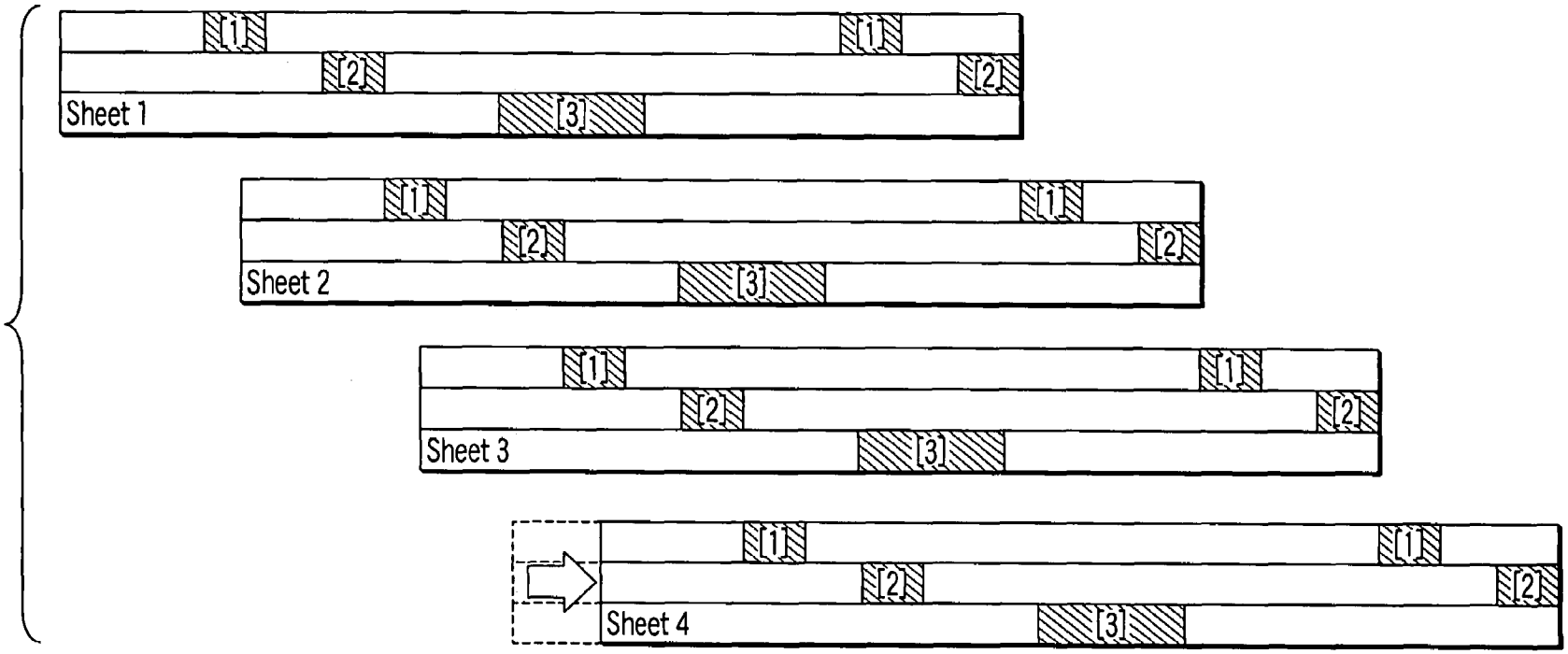
FIG. 24 is a timing chart showing that the conditions A, B, and C are met for the first, second, third, and fourth sheets to determine a conveyance start timing.

This also applies to the recording medium 7 (sheet 4). The image recording apparatus sets a temporary schedule using the time of reception of a recording instruction as a start point as shown in FIG. 22. Then, the conveyance start timing is delayed on the basis of the condition A as shown in FIG. 23. Furthermore, the conveyance start timing is delayed on the basis of the condition C as shown in FIG. 24. As a result, the schedule for the sheet 4 is determined.

Figure 25:
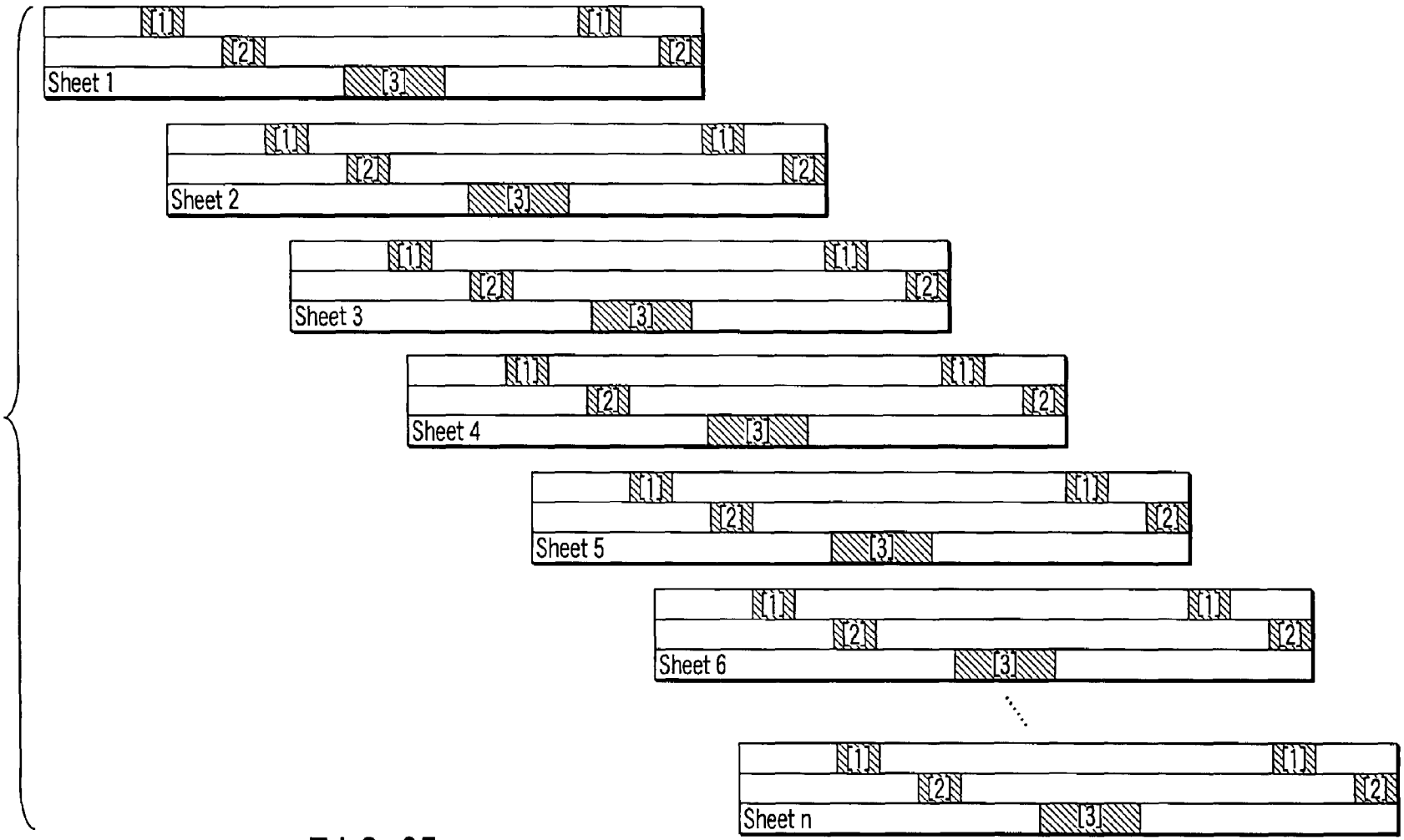
FIG. 25 is a timing chart showing that the conditions A, B, and C are met for the first to n-th sheets to determine a conveyance start timing.

Similar processing is repeatedly executed on the other recording medium 7, sheets 5 to n, to determine the schedule for consecutive double-side recording as shown in FIG. 25.

The conveyance start timing is controlled on the basis of the above scheduling. This prevents the succeeding recording medium 7 from colliding against the preceding recording medium 7 or to accomplish the maximum double-side recording speed by setting the page gap between the preceding recording medium 7 and the succeeding recording medium 7 at the minimum required value.

<Scheduling of Double-Side Recording in Case where Job Information (Recording Instruction) from Superordinate Apparatus is Delayed>

Figure 26:
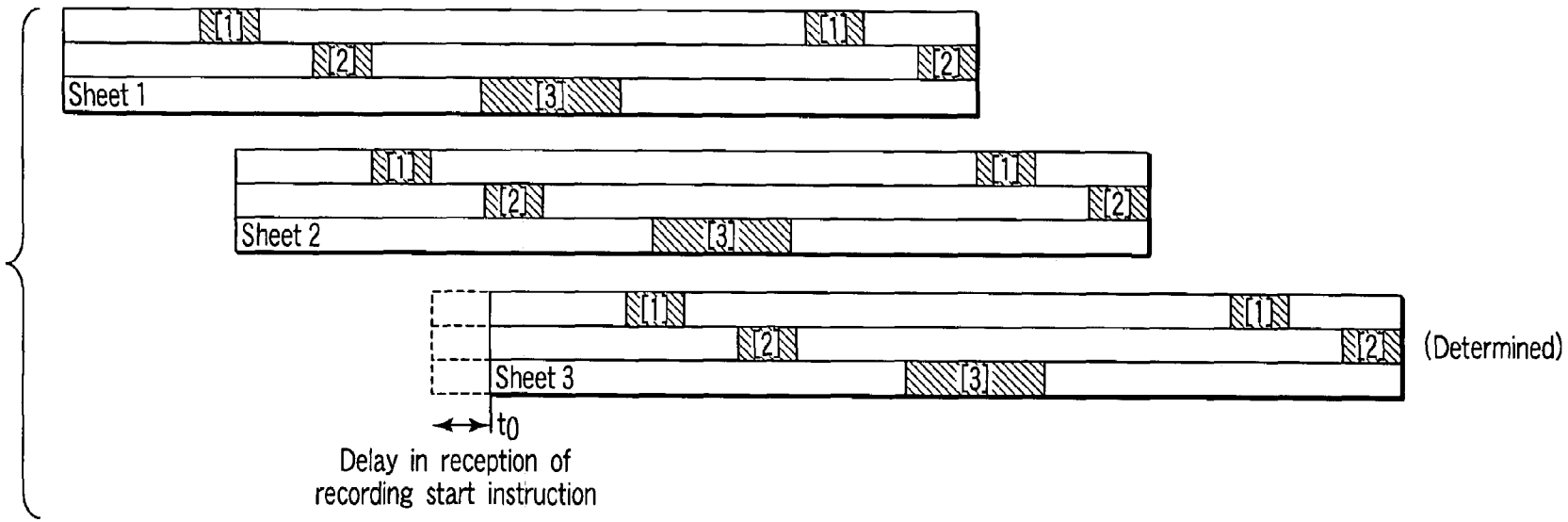
FIG. 26 is a timing chart showing that a sheet conveyance start timing for the third sheet is temporarily scheduled in connection with double-side record scheduling for the fourth sheet, for which reception of a record instruction has been delayed.
Figure 27:
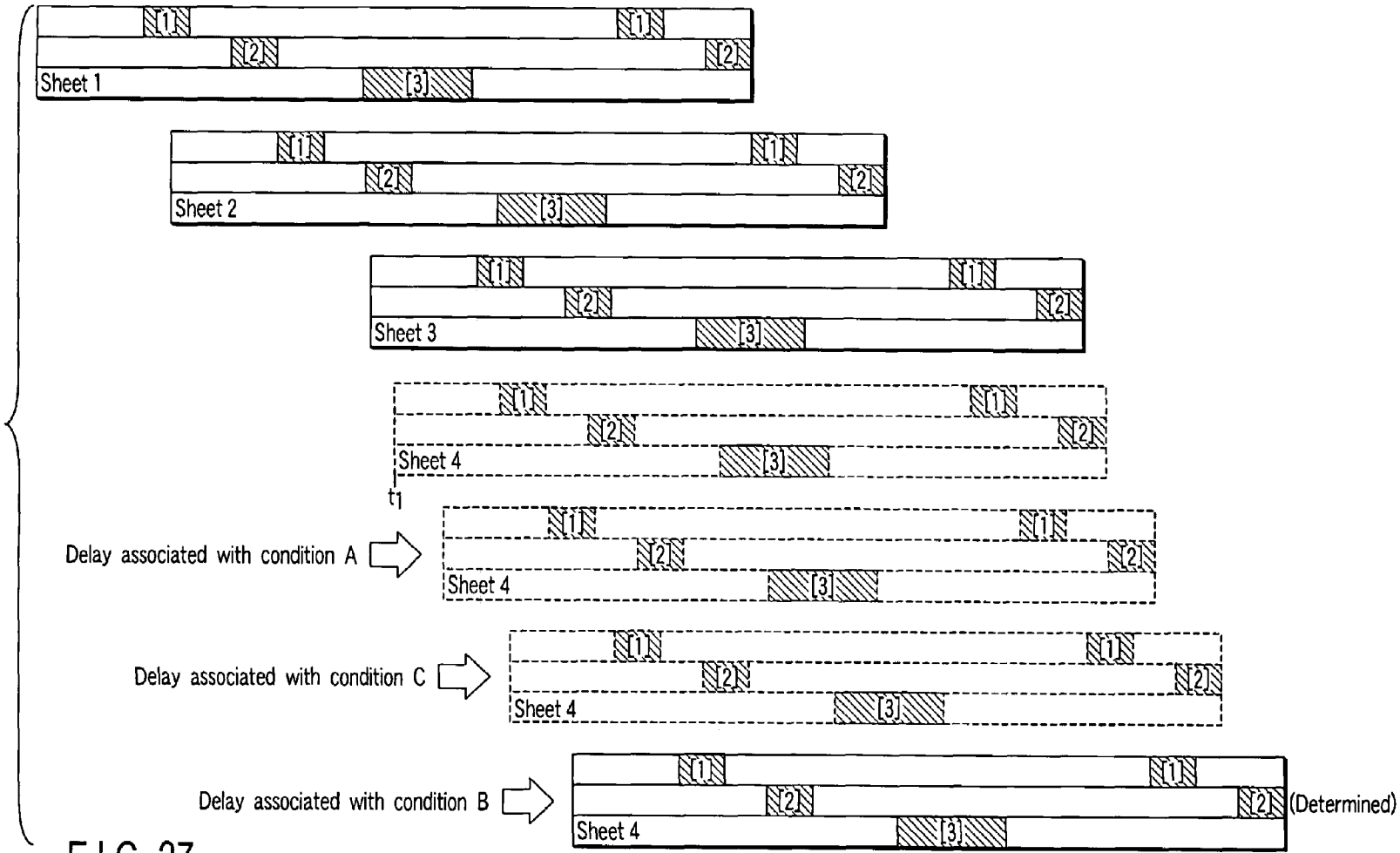
FIG. 27 is a timing chart showing that the conditions A, B, and C are applied to the fourth sheet to determine a delayed conveyance start timing.
Figure 28:
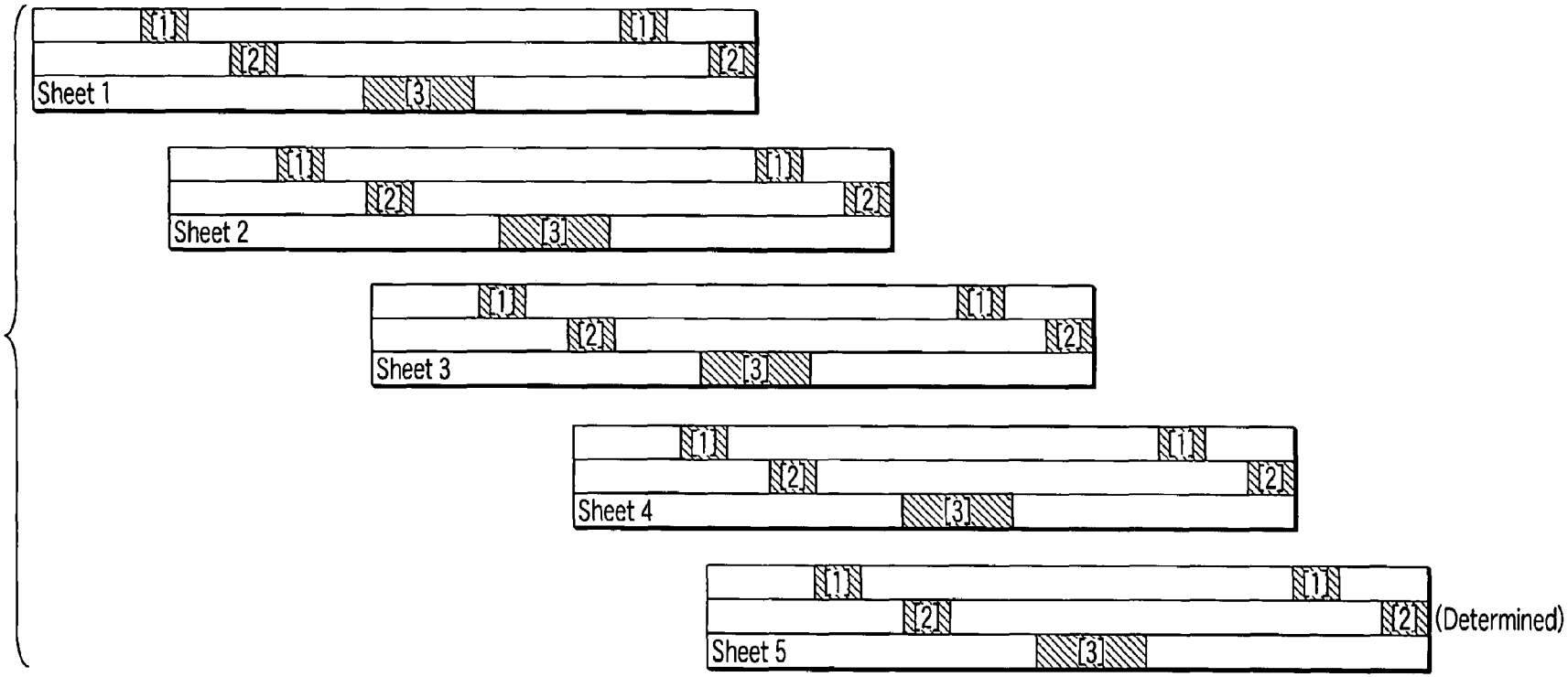
FIG. 28 is a timing chart showing that the conditions A, B, and C are met for the first to fifth sheets to determine a conveyance start timing.

Now, description will be given of scheduling carried out if the subsequent recording start instruction from the superordinate apparatus is delayed. With reference to FIGS. 26 to 28, description will be given of an example in which after the schedule for the preceding recording medium 7 (sheet 1) and succeeding recording medium 7 (sheet 2) is determined, the recording start instruction for the further succeeding recording medium 7 (sheet 3) is delayed.

The image processing apparatus receives a double-side recording instruction for the sheet 3 from the superordinate apparatus. The image recording apparatus then temporarily schedules the conveyance start timing for the sheet 3 using the time of the reception as a start point as shown in FIG. 26. In this case, the sheet 3 meets all of the conditions A to C. The process of delaying the conveyance start timing is not executed.

Subsequently, the image processing apparatus receives a double-side recording instruction for the sheet 4 from the superordinate apparatus. The image recording apparatus then temporarily schedules the conveyance start timing for the sheet 4 using the time t1 of the reception as a start point as shown in FIG. 27. First, the conveyance start timing is delayed on the basis of the condition A. Then, the conveyance start timing is delayed on the basis of the condition C. Since the conveyance start timing has been delayed on the basis of the condition C, determinations for the conditions A to C are made again. In this case, the second determination for the condition B indicates that the time of passage of the sheet 1 through the registering roller pair 13 during the second supply of the sheet 1 overlaps the time of passage of the sheet 4 through the registering roller pair 13 during the first supply of the sheet 4. Accordingly, a process of delaying the conveyance start timing is executed again. Repeated determinations based on these conditions allow the conveyance start timing for the sheet 4 to be determined.

Similar processing is executed on the recording medium 7 (sheets 5) to determine the schedule as shown in FIG. 28.

The conveyance start timing is controlled on the basis of the above scheduling. This prevents the succeeding recording medium 7 from colliding against the preceding recording medium 7 or to accomplish the maximum double-side recording speed by setting the page gap between the preceding recording medium 7 and the succeeding recording medium 7 at the minimum required value.

<Scheduling of Single-Side Recording>

To carry out single-side recording, the image recording section 3 records an image on the recording medium 7 and then conveys it to the discharging roller pair 23 without guiding it to the reversing path section 6. In this case, the recording medium 7 does not pass through the reversing roller pair 30. Thus, the above determination for the condition C is not required. That is, for single-side recording, scheduling is carried out to meet the conditions A and B.

The single-side recording will be described below in detail.

Figure 29:
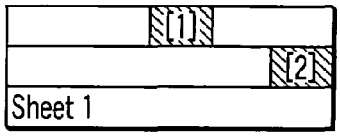
FIG. 29 is a timing chart illustrating an example of scheduling that determines a conveyance start timing for recording medium subjected to single-side recording.

The image processing apparatus receives a single-side recording instruction for the preceding recording medium 7 (sheet 1) from the superordinate apparatus. The image recording apparatus then schedules the conveyance start timing for the sheet 1 using the time of the reception as a start point as shown in FIG. 29. Then, the supply section 2 starts supplying the recording medium 7.

Figure 30:
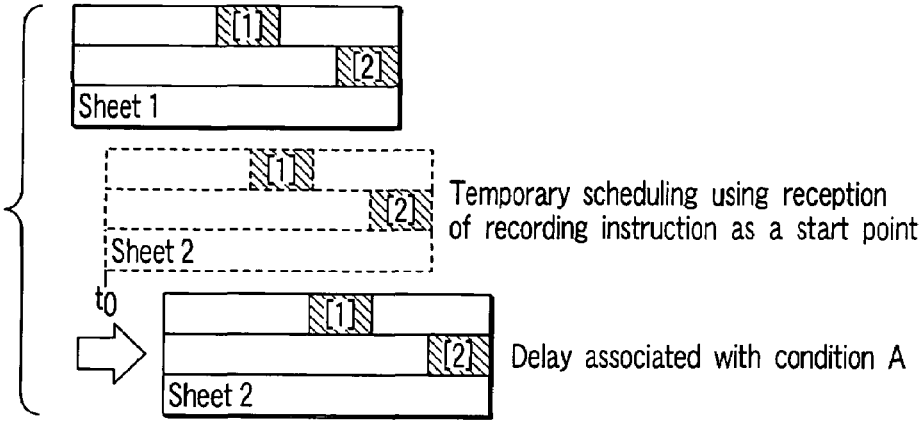
FIG. 30 is a timing chart showing that a conveyance start timing for a second recording medium is temporarily scheduled to follow the conveyance start timing for a first recording medium subjected to single-side recording, to meet the condition A.
Figure 31:
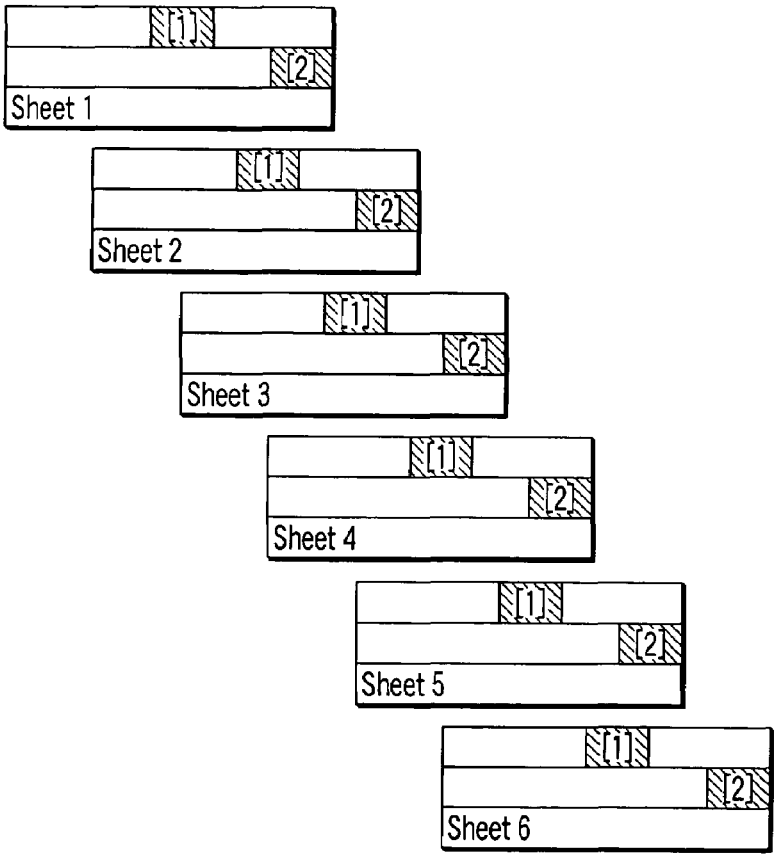
FIG. 31 is a timing chart showing that the conditions A, B, and C are met for the first to fifth sheets to determine a conveyance start timing in single-side recording.

Subsequently, the image processing apparatus receives a single-side recording instruction for the succeeding recording medium 7 (sheet 2) from the superordinate apparatus. The image recording apparatus then schedules the conveyance start timing for the sheet 2 using the time t0 of the reception as a start point as shown in FIG. 30. Subsequently, determination based on the condition A is made to delay the conveyance start timing. Further, the conveyance start timing is delayed on the basis of the condition B. For the succeeding recording medium 7, the conveyance start timing is similarly delayed by making determinations based on the conditions A and B. Thus, the schedule for consecutive single-side recording is determined as shown in FIG. 31.

As described above, for single-side recording, by controlling the conveyance start timing on the basis of the determined schedule, it is possible to set the page gap between the preceding recording medium 7 and the succeeding recording medium 7 at the minimum required value to accomplish the maximum single-side recording speed.

<Scheduling of Consecutive Process of Double-Side Recording and Single-Side Recording>

Now, description will be given of scheduling carried out if the image recording apparatus receives an instruction on a consecutive process of double-side recording and single-side recording from the superordinate apparatus.

Figure 32:
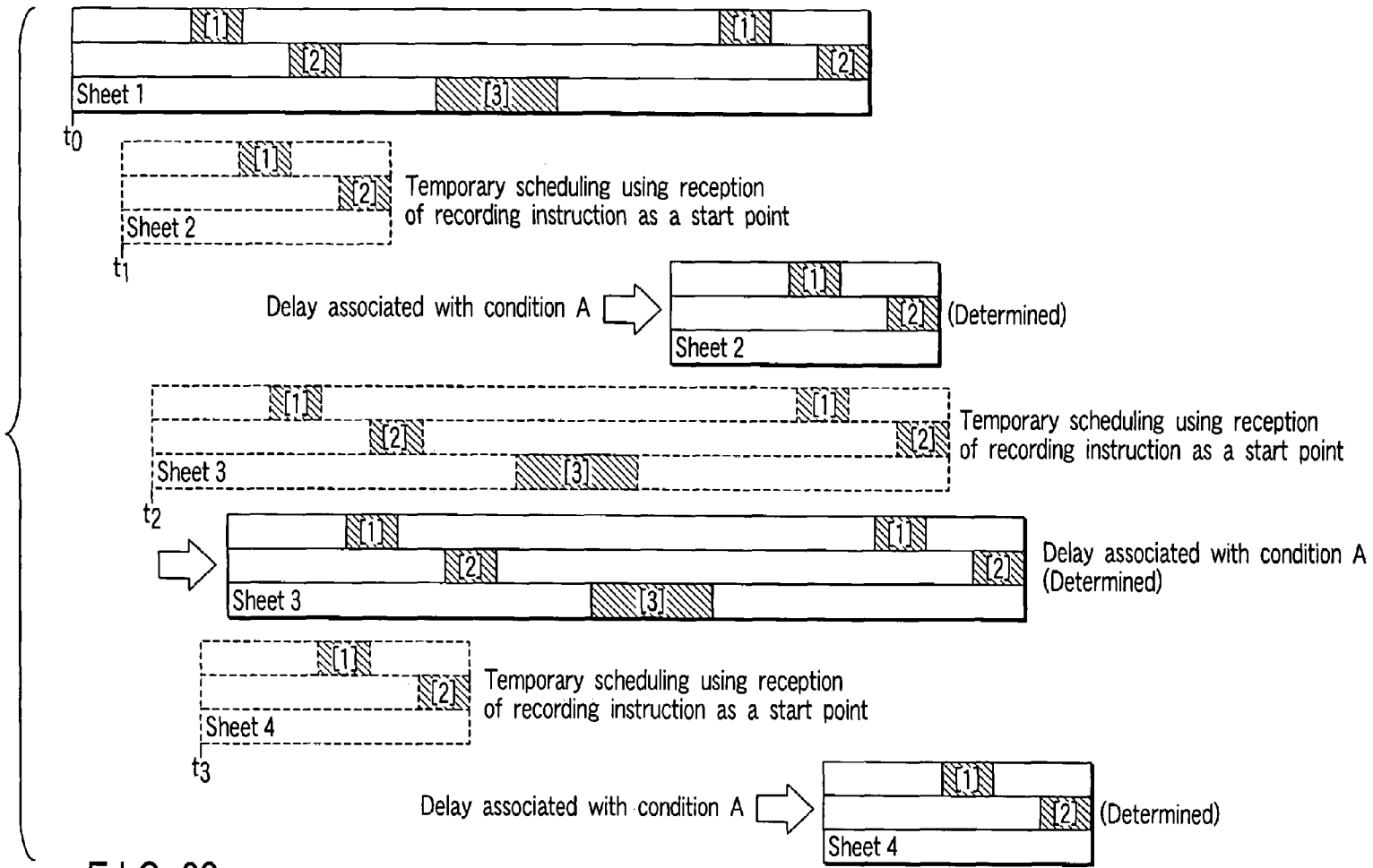
FIG. 32 is a timing chart illustrating an example of scheduling carried out if recording medium for single-side recording and recording medium for double-side recording are consecutively recorded.

The image processing apparatus receives a double-side recording instruction for the preceding recording medium 7 (sheet 1) from the superordinate apparatus. The image recording apparatus then schedules the conveyance start timing for the sheet 1 using the time t0 of the reception as a start point as shown in FIG. 32. Then, the supply section 2 starts supplying the sheet 1.

Subsequently, the image processing apparatus receives a single-side recording instruction for the succeeding recording medium 7 (sheet 2) from the superordinate apparatus. The image recording apparatus then schedules the conveyance start timing for the sheet 2 using the time t1 of the reception as a start point. Since the sheet 2 is to be subjected to single-side recording, the conveyance start timing is delayed on the basis of the conditions A and B. Thus, the conveyance start timing for the sheet 2 is determined.

Subsequently, the image processing apparatus receives a double-side recording instruction for the recording medium 7 (sheet 3) from the superordinate apparatus. The image recording apparatus then schedules the conveyance start timing for the sheet 3 using the time t2 of the reception as a start point. Since the sheet 3 is to be subjected to double-side recording, the conveyance start timing for the sheet 3 is determined by repeating determinations based on the conditions A to C and the delay of the conveyance start timing.

Subsequently, the image processing apparatus receives a single-side recording instruction for the recording medium 7 (sheet 4) from the superordinate apparatus. The image recording apparatus then schedules the conveyance start timing for the sheet 4 using the time t3 of the reception as a start point. Since the sheet 4 is to be subjected to single-side recording, the conveyance start timing is delayed on the basis of the conditions A and B. Thus, the conveyance start timing for the sheet 4 is determined.

Figure 33:
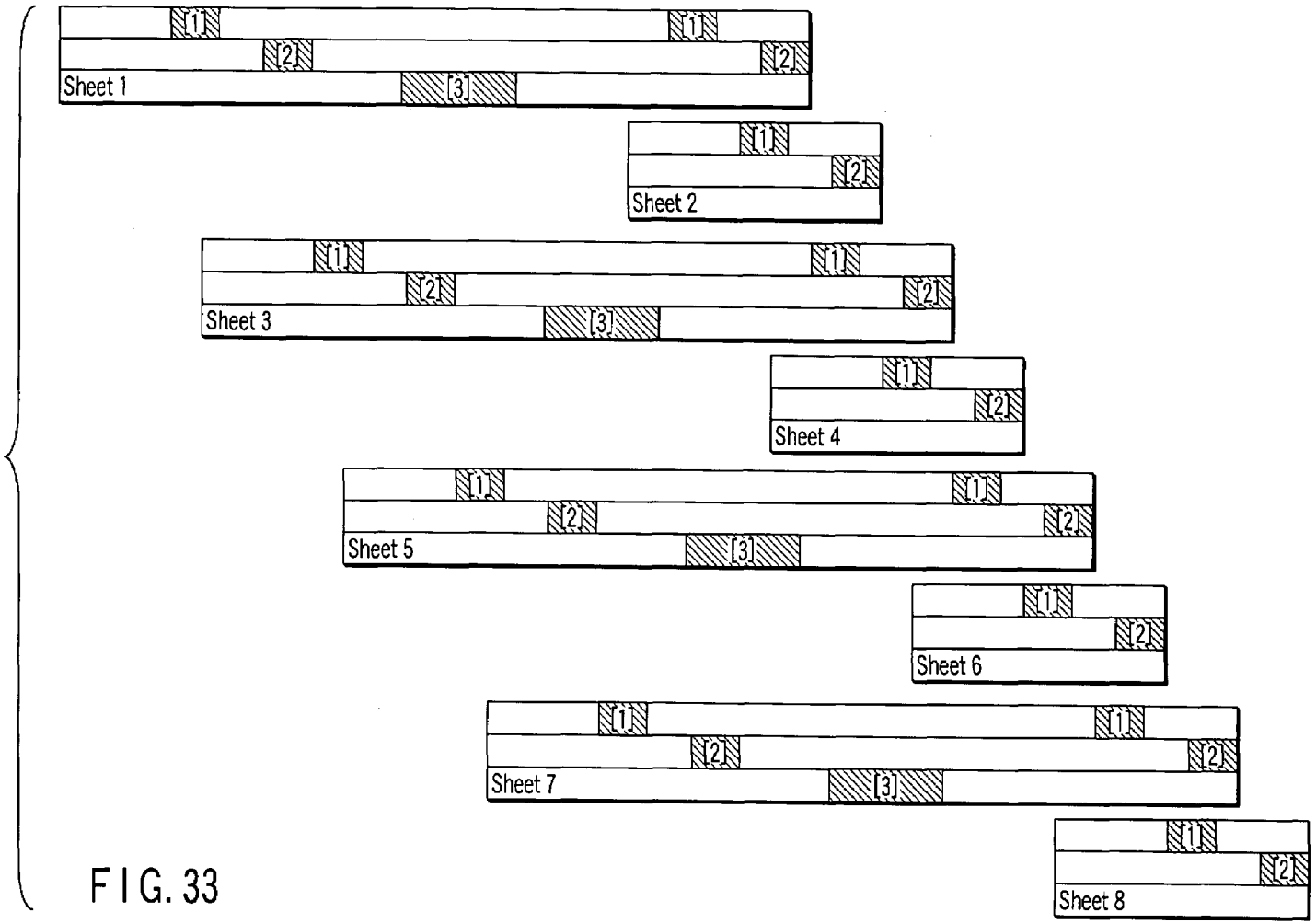
FIG. 33 is a timing chart showing that the conditions A, B, and C are met for the first to eight sheets to determine a conveyance start timing when recording medium for single-side recording and recording medium for double-side recording are consecutively recorded.

Similar determination and processing are repeatedly carried out on the subsequent recording medium 7 to determine the conveyance start timings for the consecutive process of double-side processing and single-side processing as shown in FIG. 33.

As shown in FIG. 33, in this example, an efficient conveyance start timing is determined by making the order of pages specified in the recording instruction different from the order of sheets supplied by the supply section 2. Moreover, it is possible to make the order of recording medium 7 discharged to the exterior of the image recording apparatus equal to the order specified in the recording instruction.

Consequently, even if the time to start supplying the recording medium 7 deviates from the order specified in the recording instruction, the order specified in the recording instruction matches the order of recording of images and the order in which an image was recorded on recording medium 7 housed in the housing tray 24 after image recording. This makes it possible to reduce the total time required for processing.

As described above, even if the double-side recording and single-side recording are consecutively executed, by determining conveyance start timings on the basis of scheduling, it is possible to set the page gap between the preceding recording medium 7 and the succeeding recording medium 7 at the minimum required value to accomplish the maximum double- and single-side recording speeds.

<Page Gap Control>

Now, the page gap will be described.

For consecutive double-side recording, the first path switching section 22 is rotatively moved to switch the conveying destination of the recording medium 7 between the housing section 5 and the reversing path section 6 as shown in FIG. 25. The conveying direction must be switched during the time corresponding to the page gap.

Thus, for double-side recording, a page gap larger than that for single-side recording is provided in order to perform a stable operation of conveying the recording medium 7. For single-side recording, the recording medium 7 are consecutively conveyed to the housing section 5 without the need to rotatively move the first path switching section 22. Consequently, for single-side recording, even a page gap smaller than that for double-side recording enables the recording medium 7 to be stably conveyed.

Thus, conveyance of the recording medium 7 can be scheduled as follows. If the first path switching section 22 carries out path switching, that is, if one of the preceding and succeeding recording medium 7 passing through the first path switching section 22 is conveyed for double-side recording, the larger page gap for double-side recording is used. On the contrary, if the first path switching section 22 does not carry out path switching, that is, if both the preceding and succeeding recording medium 7 are conveyed for single-side recording, the smaller page gap for double-side recording is used.

Therefore, setting the optimum page gap makes it possible to prevent the collision between the preceding and succeeding recording medium 7 in the conveying path and to increase the number of sheets recorded by the image recording apparatus per unit time. This serves to avoid a decrease in throughput, which may lower the value of the image recording apparatus.

The apparatus and method for recording an image according to the present invention uses the simple method to determine conveyance start timings for the recording medium 7 supplied to the image recording section 3, which then records an image on the first surface of the recording medium 7, and for the recording medium 7 re-supplied to the image recording section 3, which then records an image on the second surface of the recording medium 7. This prevents the succeeding recording medium 7 from colliding against the preceding recording medium 7 or accomplishes the maximum double-side recording speed by setting the page gap between the preceding recording medium 7 and the succeeding recording medium 7 at the minimum required value. Further, the maximum recording speed is accomplished for both single- and double-side recording.

By way of example, the embodiment of the present invention has been specifically described with reference to the drawings. However, the present invention is not limited to the above embodiment but includes all the embodiments carried out without departing from the spirit of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for recording an image, the method comprising:

extracting a first condition in which a plurality of recording medium are consecutively supplied and in which a leading end of the succeeding recording medium reaches a housing section while maintaining a page gap value equal to or larger than a predetermined value with respect to a time when a trailing end of the preceding recording medium passes completely through the housing section;

extracting a second condition in which the preceding recording medium and the succeeding recording medium are not present at the same time at a recording medium supply position upstream of an image recording section which records an image on the recording medium and in which the leading end of the succeeding recording medium reaches the supply position while maintaining a page gap value equal to or larger than a predetermined value with respect to a time when the trailing end of the preceding recording medium passes completely through the supply position;

extracting a third condition in which the preceding recording medium and the succeeding recording medium are not present at the same time at a reversing path section which turns recording medium upside down so that a second surface, that is, a back surface, faces upward instead of a first surface, that is, a front surface and in which the leading end of the succeeding recording medium reaches the position of the reversing path section while maintaining a page gap value equal to or larger than a predetermined value with respect to a time when the trailing end of the preceding recording medium passes completely through the position of the reversing path section; and for single-side recording in which an image is recorded only on the first surface, that is, the front surface of the recording medium, determining a conveyance start timing for the succeeding recording medium on the basis of scheduling which meets the extracted first and second conditions, and for double-side recording in which an image is recorded on both sides of the recording medium including the first surface, that is, the front surface, and a second surface, that is, a back surface, determining the conveyance start timing for the succeeding recording medium on the basis of scheduling which meets the extracted first, second, and third conditions.

2. The method for recording an image according to claim 1, wherein if the double-side recording and the single-side recording are consecutively processed, the conveyance start timing for the succeeding recording medium is determined on the basis of scheduling which meets the extracted first, second, and third conditions.

3. The method for recording an image according to claim 1, wherein the page gap value for the double-side recording is set larger than that for the single-side recording.

4. The method for recording an image according to claim 1, wherein in the extraction of the first condition, the timing position through which the trailing end of the preceding recording medium passes completely has a position of a discharging and conveying roller pair.

5. The method for recording an image according to claim 1, wherein in the extraction of the second condition, the timing position through which the trailing end of the preceding recording medium-passes completely has a position of a registration section.

6. The method for recording an image according to claim 1, wherein in the extraction of the third condition, the timing position through which the trailing end of the preceding recording medium passes completely has a position of a reversing roller pair.

7. The method for recording an image according to claim 1, wherein if the single-side recording of the recording medium and the double-side recording of the recording medium are consecutively processed, if both the preceding recording medium and the succeeding recording medium are subjected to the single-side recording, a predetermined page gap value for single-side recording is selected, if one of the preceding recording medium and the succeeding recording medium is subjected to the double-side recording, a predetermined page gap value for double-side recording is selected, and scheduling is carried out so that the conveyance start timing for the succeeding recording medium is delayed on the basis of the selected page gap value.

* * * * *